US008061321B2

(12) United States Patent
Takeuchi et al.

(10) Patent No.: US 8,061,321 B2
(45) Date of Patent: Nov. 22, 2011

(54) IGNITION DEVICE

(75) Inventors: Takayuki Takeuchi, Aichi-ken (JP); Masamichi Shibata, Toyota (JP)

(73) Assignees: Nippon Soken, Inc., Nishio, Aichi-Pref. (JP); Denso Corporation, Kariya, Aichi-Pref. (JP)

( * ) Notice: Subject to any disclaimer, the term of this patent is extended or adjusted under 35 U.S.C. 154(b) by 336 days.

(21) Appl. No.: 12/411,769

(22) Filed: Mar. 26, 2009

(65) Prior Publication Data

US 2009/0244802 A1 Oct. 1, 2009

(30) Foreign Application Priority Data

Mar. 28, 2008 (JP) ..... 2008-085805
Dec. 26, 2008 (JP) ..... 2008-332047

(51) Int. Cl.
*F02P 23/00* (2006.01)

(52) U.S. Cl. ..... 123/143 R; 123/145 R; 123/169 PA

(58) Field of Classification Search ..... 123/143 B, 123/143 R, 169 R, 169 EL, 145 R, 169 PA, 123/536, 596, 606, 615, 620, 627, 640; 313/118, 313/134, 141–144; 315/34, 39, 39.63; 361/247
See application file for complete search history.

(56) References Cited

U.S. PATENT DOCUMENTS

| | | | | |
|---|---|---|---|---|
| 3,361,929 | A * | 1/1968 | Vandover | 315/55 |
| 7,117,827 | B1 * | 10/2006 | Hinderks | 123/43 R |
| 7,305,954 | B2 * | 12/2007 | Hagiwara et al. | 123/143 B |
| 7,543,578 | B2 * | 6/2009 | Czimmek | 123/606 |
| 2007/0221156 | A1 | 9/2007 | Hagiwara et al. | |
| 2007/0221157 | A1 | 9/2007 | Hagiwara et al. | |
| 2009/0031984 | A1 * | 2/2009 | Shiraishi et al. | 123/260 |

FOREIGN PATENT DOCUMENTS

| | | |
|---|---|---|
| JP | 2006-294257 | 10/2006 |
| JP | 2007-141786 | 6/2007 |
| JP | 2007-287666 | 11/2007 |

* cited by examiner

*Primary Examiner* — John Kwon
*Assistant Examiner* — Johnny Hoang
(74) *Attorney, Agent, or Firm* — Nixon & Vanderhye PC

(57) ABSTRACT

The ignition device is comprised of a center electrode, an insulator having a tubular shape for covering the center electrode, and a ground electrode having an open portion communicating with an open portion of the insulator, the ground electrode covers the insulator. The center electrode, the insulator and the ground electrode define a discharge space of the ignition device. The discharge space is provided with high voltage from a discharge power source and high current from a plasma energy supply power source to form plasma having high temperature and high pressure in the discharge space.

6 Claims, 20 Drawing Sheets

IGNITION DEVICE

CROSS REFERENCES TO RELATED APPLICATION

This application is based on and claims the benefit of priority from earlier Japanese Patent Applications No. 2008-085805 and No. 2008-332047 filed on Mar. 28, 2008 and Dec. 26, 2008, respectively, the descriptions of which are incorporated herein by reference.

BACKGROUND OF THE INVENTION

1. Technical Field of the Invention

The present invention relates to an ignition device having improved ignition performance, which is used for an internal combustion engine.

2. Description of the Related Art

The internal combustion engine mounted to machines such as automobiles has been required to have improved fuel consumption and lean combustion in order to reduce the environmentally undesirable substances such as nitrogen oxides and carbon dioxide that are included in the exhaust gas.

An effective combustion means using a lean air-fuel mixture, on which the conventional spark-discharge type plug can not perform ignition, has been regarded as a desired internal combustion engine that can improve the combustion efficiency and can reduce these vehicle emissions with a mechanism of injecting plasma having high temperature and high pressure into the internal combustion engine.

Japanese Patent Application Laid-open Publication No. 2006-294257 discloses such an ignition device that comprises a housing for separating a chamber having an opening and a bottom face disposed opposite to the opening and having a circular shape in section; an external electrode provided at a surface of the housing which includes a hole for communicating the opening of the chamber with the outside; and a center electrode provided at a bottom face of the chamber.

Plasma is generated in the chamber by applying voltage between the center electrode and the external electrode to eject a plasma jet through the opening of the chamber. The cubic capacity of the chamber is made 10 $mm^3$ or less, and the aspect ratio between the axial length and the inner diameter of the chamber is made two or more.

This ignition device allows the ejected plasma having high temperature and high pressure generated in the chamber to travel a long distance, and allows the fuel density of air-fuel mixture to be relatively high when using lean stratified combustion. Therefore, this ignition device was expected to improve the ignition performance of the lean fuel combustion.

However, this ignition device allows the plasma ejected in the internal combustion engine to maintain its high energy condition for a very short time only because of the high current applied in a discharge space for a very short time, 10 μsecond or less, caused by insulation breakdown in the discharge space by an application of high current.

Therefore, a relatively high energy, 200 mJ for example, was required to make flame kernels grow and spread in the air-fuel mixture to ignite. Further, advancement in the degree of density in the lean mixed gas was reaching its limit, though such high energy was provided. Moreover, the application of the high energy drastically wore electrodes, which limited the improvement of durability and reliability of the ignition device.

Lately, fluidization of the high gas in a combustion chamber has been progressed by improved swirl ratio or by generation of powerful tumble vortexes in the combustion chamber with use of a supercharger in order to properly mix fuel with compressed air.

For this reason, the conventional plasma ignition device could not easily ignite these combustion engines because flame kernels ejected in a combustion chamber are blown out by the powerful gas flow generated in the chamber, thereby losing energy before growing to a sufficiently large size needed for ignition.

SUMMARY

It is therefore an object of the present invention to provide an ignition device that makes flame kernels grow and is good in ignition performance and durability, which is designed to ignite by ejecting plasma in a combustion chamber of a combustion engine using fuel of relatively low flammability such as a lean homogeneous fuel combustion engine, a lean stratified combustion engine, a supercharging mixed combustion engine, and an ammonia combustion engine.

An ignition device in the present invention comprises a center electrode, an insulator and a ground electrode. The center electrode has a long shaft shape. The insulator has a tubular shape and covers the center electrode. The insulator extends below the center electrode. The ground electrode has an open portion that communicates with an open portion of the insulator.

The ground electrode covers the insulator. The center electrode, the insulator and the ground electrode define a discharge space of the ignition device.

The discharge space is provided with high voltage from a discharge power source and high current from a plasma energy supply power source to form plasma having high temperature and high pressure in the discharge space. The plasma is ejected in a combustion chamber to cause ignition.

A rotation supply mechanism is provided, which supplies rotational force to the gas flow that is ejected from the discharge space and has high temperature and high pressure. The rotational force acts in a direction from the periphery to the center of the gas flow.

The ignition device in the present invention causes the plasma having high temperature and high pressure to be ejected in a form of a doughnut-shaped vortex ring by the rotation supply mechanism that supplies the rotational force to the gas in the direction from its periphery to its inner side.

The vortex rings rotate and advance forward in the combustion chamber, so that they receive less air resistance and thus can move a long distance. The vortex ring encloses the gas having high energy and provides the high energy to the air-fuel mixture while absorbing the surrounding air-fuel mixture by its rotational movement, which allows each flame kernel to grow in a form of the doughnut shape.

The ignition device allowing the flame kernels to steadily grow improves the ignition performance of a combustion engine using fuel of relatively low flammability such as a lean homogeneous fuel combustion engine, a lean stratified combustion engine, and a supercharging mixed combustion engine. Accordingly, the ignition device according to the present invention is highly reliable in ignition performance.

Further, the ignition device in the present invention can keep the energy provided from the plasma energy supply power source inside the flame kernels for a long time, which allows the energy to be effectively utilized for growing the flame kernels and allows the ignition to be performed with low energy. Accordingly, the ignition device restrains the electrodes from wearing out, thereby providing high durability and reliability to the ignition device.

Specifically, the open portion of the ground electrode can be designated as a first open portion, and the rotation supply mechanism can be designed as a second open portion provided at an apical end side of the first open portion, in which the second open portion provides a rotation supply space defined by its tubular peripheral wall face.

This ignition device generates a significant speed difference between the center portion and the outer periphery portion of the gas having high energy, because of the expanded open area in cross section in the rotation supply space which permits the gas ejected from the first open portion to pass through. This speed difference generates powerful rotational force in the gas having high energy, and produces a vortex ring that rotates while expanding in the outer radial direction.

The gas having high energy is enclosed inside the vortex ring, without being dispersed, by the rotation of the vortex ring. Further, the surrounding air-fuel mixture is enclosed in the vortex ring by the rotational force, and is effectively reacted with the gas having high energy. Thus, each flame kernel grows rapidly while still keeping its vortex ring form. Accordingly, the ignition device is provided with the good ignition performance.

More specifically, the ignition device should satisfy the following formula 1.

$$1.0 \times D1 < D2 < 4.5 \times D1 \quad \text{(formula 1)}$$

In this formula, ϕD1 refers to an opening diameter of the first open portion, and D2 refers to a distance between two opposing wall faces of the second open portion.

The inventors have found out that the above mentioned arrangement, which defines the relation between the opening diameter D1 of the first open portion and the distance D2 between two opposing walls of the second open portion, enables the vortex ring to be maintained for the longest time.

Further, the ignition device should satisfy the following formula 2.

$$0 < H2 \leqq 2.7 \quad \text{(formula 2)}$$

In this formula, H2 (mm) refers to a height of the peripheral wall face of the second open portion.

The inventors have also found out that the above mentioned arrangement of the height H2 of the peripheral wall face of the second open portion enables the vortex ring to be maintained for the longest time.

Further, an inner face of the peripheral wall of the second open portion can be circularly concaved partially toward the external side.

Such a configuration generates a vortex ring that rotates in the concave-formed rotation supply space while expanding in the outer radial direction. And, while the vortex ring stays in the rotation supply space, the subsequent plasma that is ejected accelerates the circumferential velocity of the vortex ring from the discharge space.

When the circumference velocity reaches a substantially high degree, a part of the vortex ring comes out from the rotation supply space, which pulls the rest, and thus a larger size of the vortex ring is ejected from the apical end of the second open portion into a combustion chamber.

This action induces powerful rotational force and allows the flame kernel to grow in the maintained vortex ring form, which provides the ignition device with the good ignition performance.

Further, the inner face of the peripheral wall of the second open portion is partially narrowed toward its apical end to form the rotation supply space that has substantially a circular conical shape.

Such a configuration generates a vortex ring that rotates in the rotation supply space having the circular conical shape while expanding in the outer radial direction. And, while the vortex ring stays in the rotation supply space, the subsequent plasma that is ejected accelerates the circumferential velocity of the vortex ring from the discharge space.

When the circumference velocity reaches a substantially high degree, a part of the vortex ring comes out from the rotation supply space, which pulls the remaining larger size of the vortex ring ejected from the apical end of the second open portion into a combustion chamber.

This action induces powerful rotational force and allows the flame kernel to grow in the vortex ring form, which provides the ignition device with the good ignition performance.

Further, the ignition device can be made to satisfy the following formula 3.

$$H1/D1 \geqq 5 \quad \text{(formula 3)}$$

In this formula, H1 refers to the length of an inner peripheral wall of the insulator between the lower end face of the center electrode and the upper end of an inner peripheral wall of the opening portion of the ground electrode, both forming the discharge space by a combination, and ϕD1 refers to the inner diameter of an inner peripheral wall of the insulator.

This ignition device allows such high energy ejected gas to sustain a vortex ring form for sufficiently long in the discharge space to provide good ignition performance.

Further, the ignition device enables the gas having high energy to form a stable vortex even under the low aspect ratio, which can decrease required voltage and improve durability.

The high current from the plasma energy supply power source can be supplied in a divided manner by pulse current with respect to a single provision of the high voltage from the discharge power source.

This invention allows the flame kernel to grow further by permitting the flame kernel to absorb higher energy from the succeeding plasma that accelerates the circumferential velocity of the vortex ring by hitting the flame kernel ejected in a form of the vortex ring still growing. This can provide the ignition device with the excellent ignition performance.

DETAILED DESCRIPTION OF PREFERRED EMBODIMENTS

Figure 1:
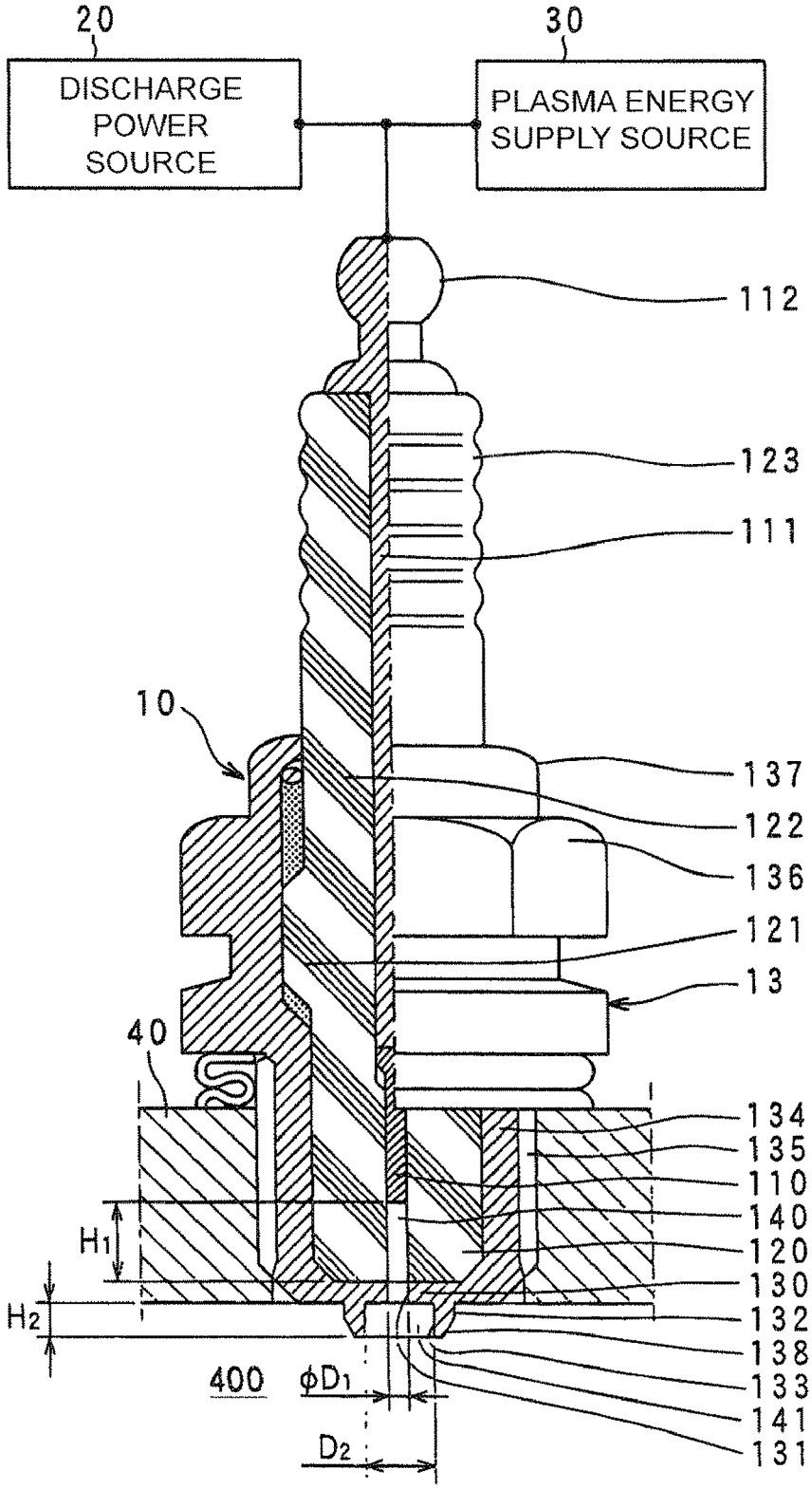
FIG. 1 is an overall view showing an ignition device in a first embodiment of the present invention.

An ignition device of a first embodiment according to the present invention will be described hereinafter referring to FIG. 1. The ignition device comprises an ignition plug 10, a discharge power source 20 used for supplying high voltage to the ignition plug 10, and a plasma energy supply power source 30 used for supplying high current to the ignition plug 10. The ignition plug 10 is mounted to an engine 40, exposing its apical end in a combustion chamber 400.

The ignition plug 10 consists of a center electrode 110 having a long shaft shape, an insulator 120 having a tubular shape made for covering and holding the center electrode 110 from its outer circumference in an insulation manner, and a ground electrode 130 having a tubular shape for covering the insulator 120.

The center electrode 110 is made of material having high heat resistance and good electrical conductivity performance. The center electrode 110 consists, at its base end side, of a center electrode intermediate portion 111 provided with good electrical conductivity performance and good heat conductivity performance; and a center electrode terminal portion 112, at its base end, to be coupled with the discharge power source 20 and the plasma energy supply power source 30.

The insulator 120 is made of alumina of high purity provided with good heat resistance, mechanical strength, dielectric strength in high temperature, and heat conductivity. The insulator 120 has a tubular shape and extends below the apical end of the center electrode 110.

The insulator 120 includes an engagement portion 121 at its middle portion having an enlarged diameter, which is engaged with an inside of a housing 13 via a seal member (not shown) that seals between the insulator 120 and the housing 13.

The insulator 120 includes a head portion 123 having a corrugated shape at its base end side, which insulates the center electrode terminal portion 112 from a surface of the housing 13 to prevent leakage of high voltage.

The ground electrode 130, made of electrically conductive metal, is formed in a tubular shape to cover the insulator 120 and has a first open portion 131 that communicates with a bottom end open portion of the insulator 120.

The ground electrode 130 bends toward the center at its apical end side to partially cover a bottom portion of the insulator 120. A discharge space 140 is provided, which is defined by an inner peripheral wall of the insulator 120, a bottom face of the center electrode 110, and the first open portion 131.

The ground electrode 130 is composed of a second open portion 132 that includes a rotation supply space 141 as the rotation supply mechanism that is a primary construction of the present exemplary embodiment. The rotation supply space 141 is formed by a tubular peripheral wall 133 that projects toward the apical end side of the first open portion 131, surrounding the first open portion 131.

In this embodiment, the length H1 of the discharge space 140, the height H2 of the inner peripheral wall face 133 of the second open portion 132, the inner diameter of the discharge space 140 (that is the inner diameter ϕD1 of the first open portion 131 and the inner diameter ϕD2 of the second open portion 132) are provided with the following sizes in order to satisfy the relation between them by the following sizes.

The length H1 is a distance between the bottom surfaces of the center electrode 110 exposed in the discharge space 140 and the border between the inner peripheral wall of the first open portion 131 and the insulator 120.

H1=3.0 mm, H2=1.0 mm, D1=1.3 mm, D2=3.0 mm.

$$0 \times D1 < D2 < 4.5 \times D1 \quad \text{(formula 1)}$$

$$0 < H2 \leqq 2.7 \quad \text{(formula 2)}$$

$$H1/D1 \geqq 1.5 \quad \text{(formula 3)}$$

The ground electrode 130 is composed of a rear side electrode 134 having a tubular shape which extends toward the base end side, and whose walls oppose with each other with an intermediary of the center electrode 110 and the insulator 120.

The rear side electrode 134 is attached at its base end side with a housing 13 that is fixed to a wall face 40 of a combustion chamber 400 (not shown in FIG. 1), allowing the second open portion 132 to be exposed in the combustion chamber and electrically connecting the ground electrode 130 to the inner wall face 40, besides supporting the insulator 120.

The rear side electrode 134 is provided at its outer periphery with a threaded portion 135 to be coupled in a screw-in manner. The housing 13 is provided at its outer periphery portion in the base end side with a hexagon portion 136 to be used for tightening the threaded portion 135. A caulking portion 137 is also provided to fix the insulator 120 to the housing by caulking.

Figure 2A:
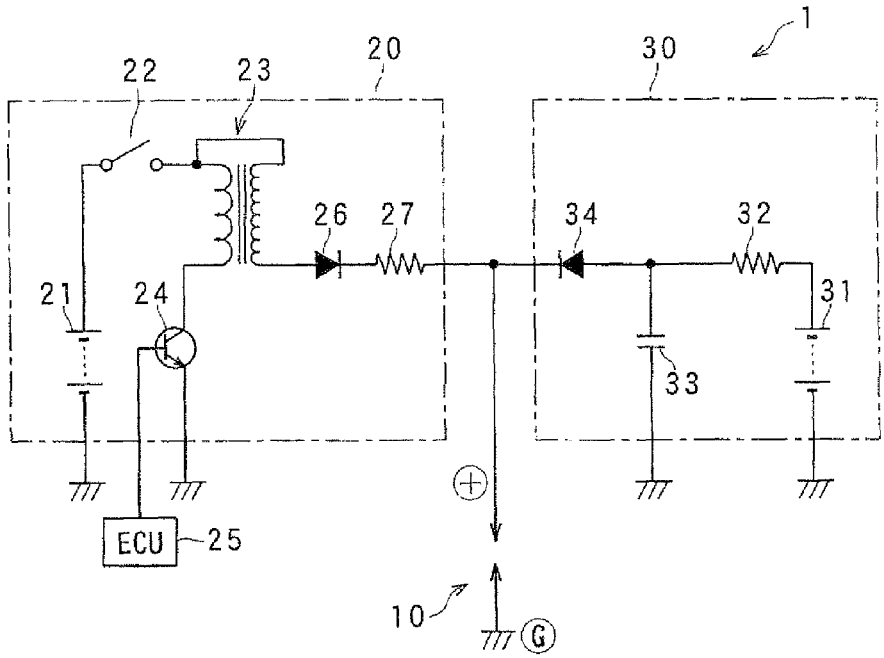
FIG. 2A is a schematic view of an equivalent circuit of the ignition device in the first embodiment of the present invention.

FIG. 2A illustrates an equivalent circuit of the ignition device 1 of the present invention. The discharge power source 20 consists of a first power source 21, an ignition key 22, an ignition coil 23, an ignition coil driving circuit 24, an electronic control device 25, a first rectifier cell 26, and a radio noise absorption resistance 27.

The discharge power source 20 should be arranged so that the first rectifier cell 26 makes the center electrode 110 a positive electrode in order to restrain wearing of the electrode.

The plasma energy supply power source 30 consists of a second power source 31, a radio noise absorption resistance 32, a second rectifier cell 34, and plasma energy charge condensers 33. The plasma energy supply power source 30 should be arranged so that the second rectifier cell 34 makes the center electrode 110 a positive electrode in order to restrain wearing of the electrode.

Figure 2B:
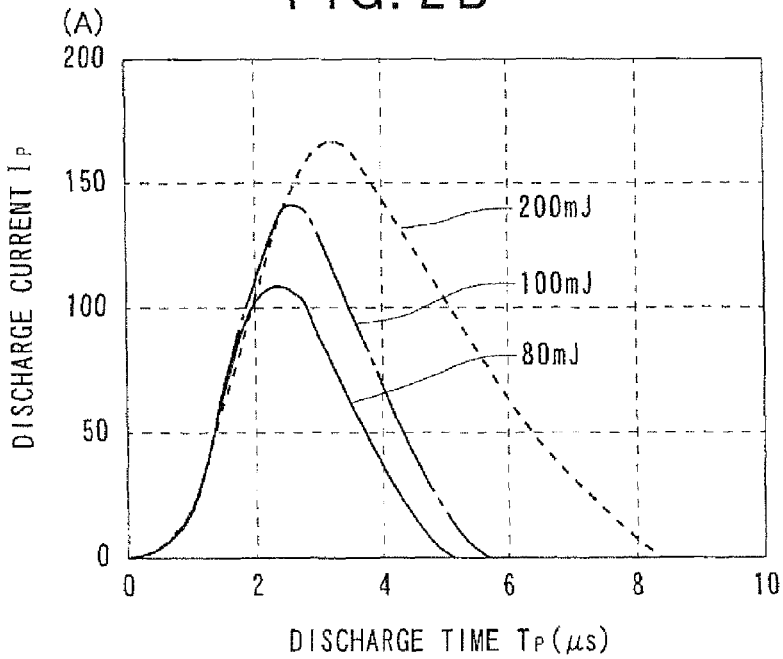
FIG. 2B is a current characteristic view showing the same equivalent circuit of the ignition device.

When breakdown discharge occurs, which breaks the insulation of the discharge space 140, by high voltage supplied from the discharge power source 20, high current IP generated by energy reserved in the plasma energy charge condensers 33 flows at once in a very short discharge time TP. FIG. 2B shows the relation among the discharge current IP, the supplied energy, and the discharge time TP.

Figure 3A:
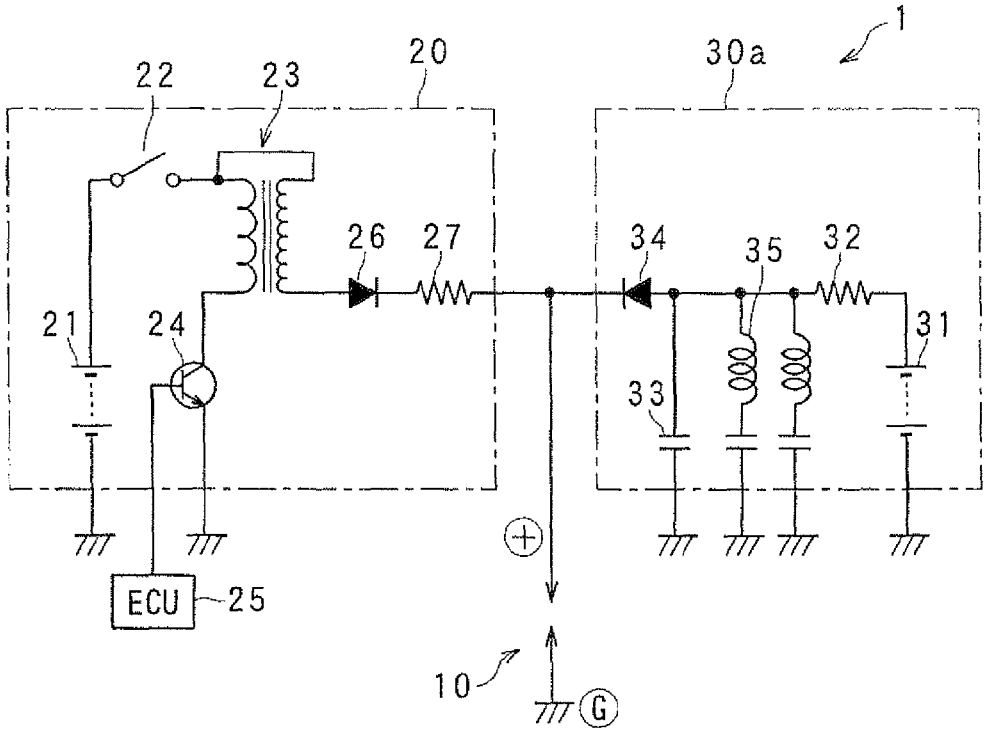
FIG. 3A is a schematic view of another equivalent circuit of the ignition device to be used in the first embodiment of the present invention.
Figure 3B:
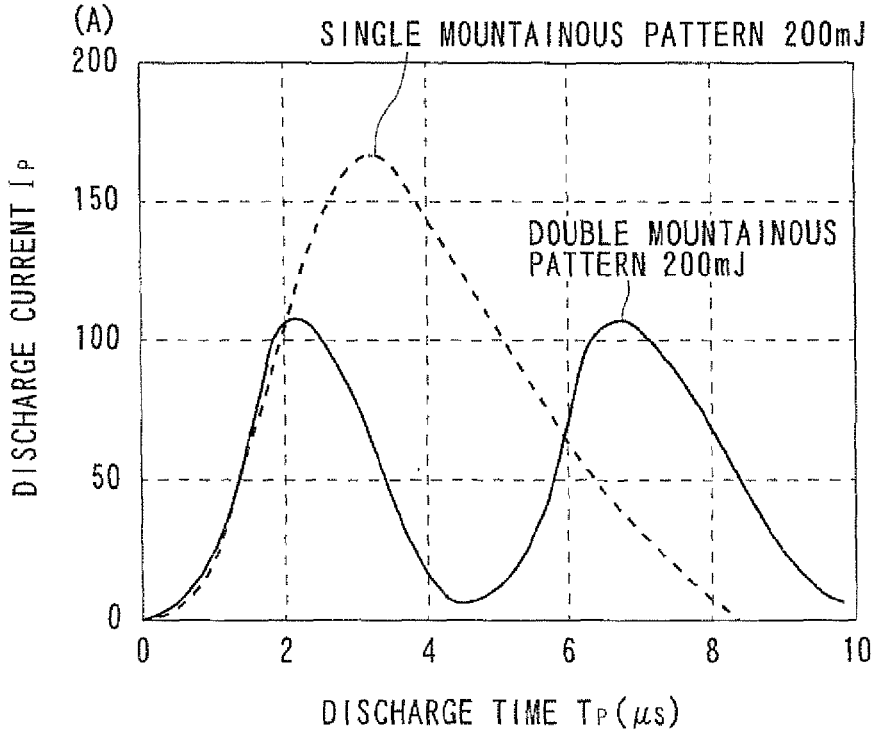
FIG. 3B is a current characteristic view showing the same equivalent circuit of the ignition device.

FIG. 3A illustrates another equivalent circuit of the first ignition device in addition to the elements shown in FIG. 2A. Preparation of a plurality of choke coils 35 and condensers 33 in parallel with the plasma energy discharge condensers 33 allows such energy to be dividedly supplied, as shown in FIG. 3B, by a plurality of intense pulses in a single ignition that has the same amount of energy as if it was discharged at once. One of the choke cons 35 at a downstream side is made low inductance, while another is made high inductance.

In this construction, the breakdown discharge from the discharge power source 20 breaks down the insulation of the discharge space 140, which is followed by 3 consecutive discharges. First, the condenser 33 not provided with the choke coil 35 discharges first high current, then the condenser 33 provided with the low inductance choke coil 35 discharges delayed second current, and finally the condenser 33 provided with the high inductance choke coil 35 discharges further delayed third current.

Figure 4A:
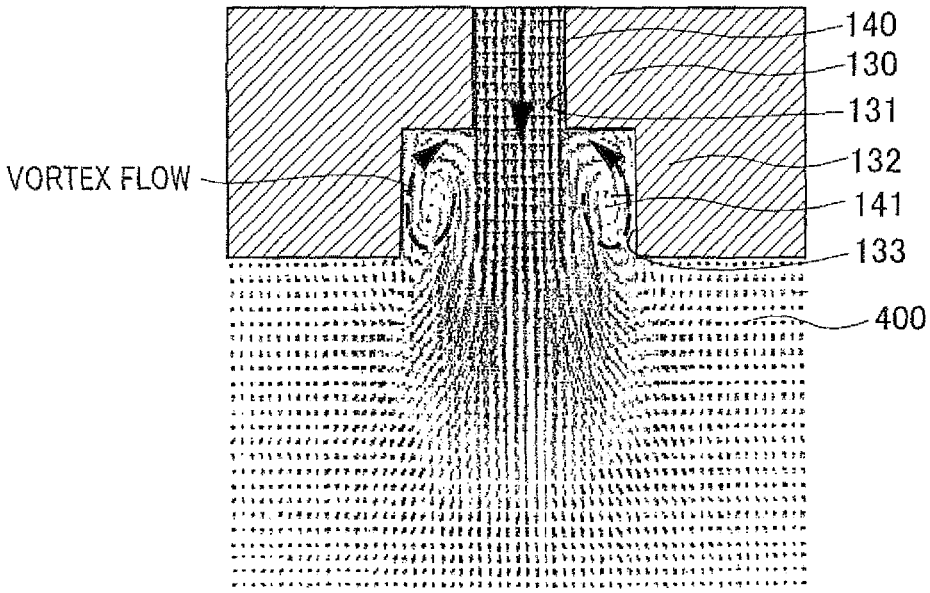
FIG. 4A is an analysis view showing a simulation at a state 0.1 ms after the plasma is ejected.
Figure 4B:
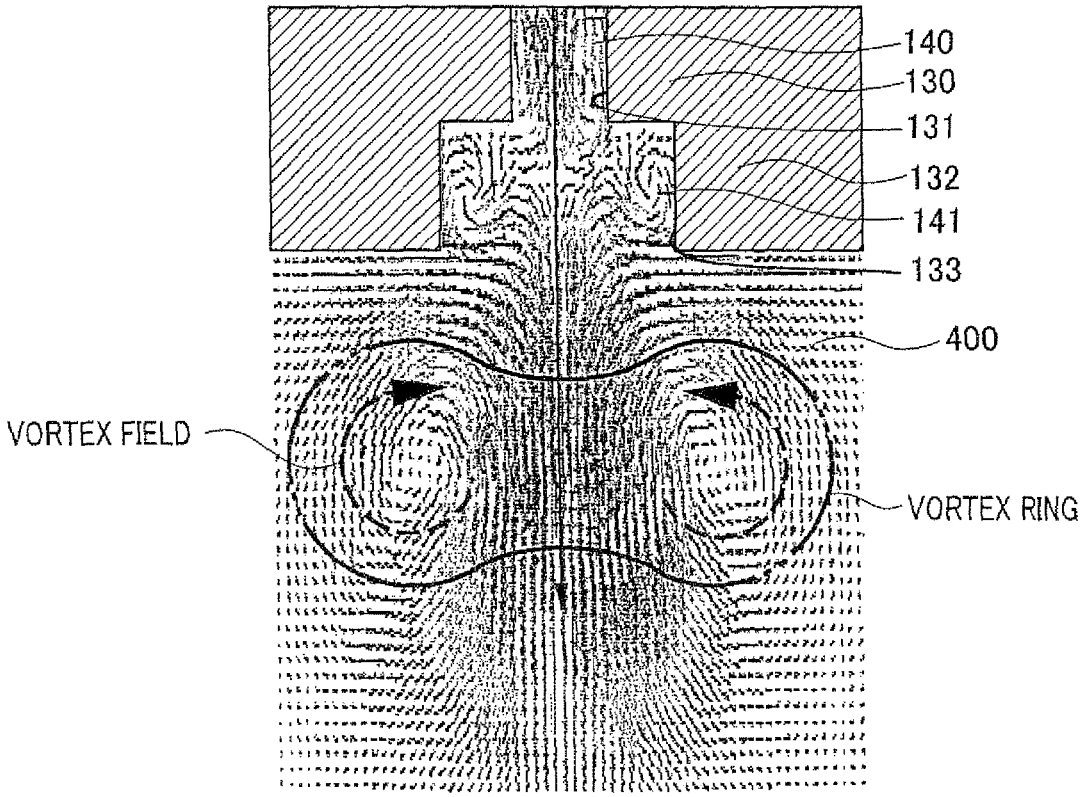
FIG. 4B is an analysis view showing a simulation at a state 0.35 ms after the plasma is ejected.

Advantages of the embodiment in the present invention will be described hereinafter referring to FIGS. 4 to 6. FIG. 4A is an analysis view showing a simulation at a state 0.1 ms after the plasma is ejected, and FIG. 4B is an analysis view showing a simulation at a state 0.35 ms after the plasma is ejected.

Figure 5A:
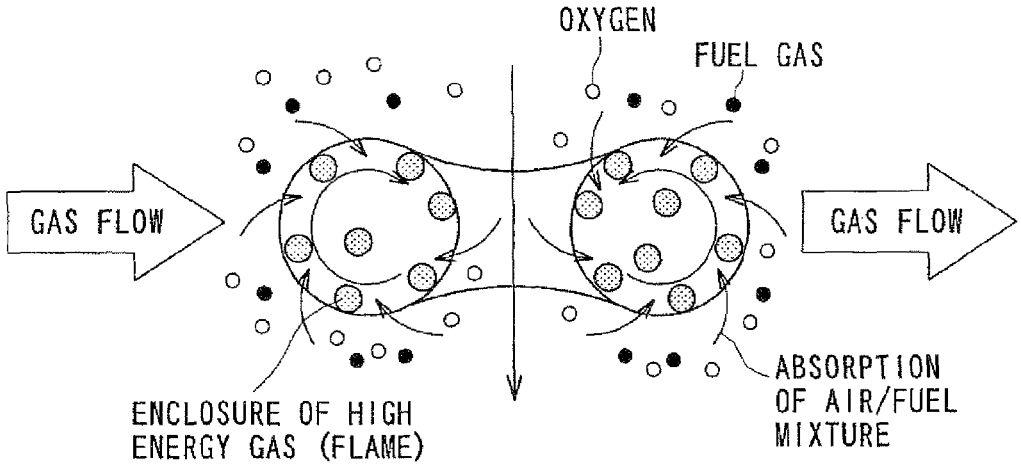
FIGS. 5A and 5B are schematic diagrams showing a flame kernel, ejected from the ignition device, which is growing from a state shown in FIG. 5A to a subsequent state shown in FIG. 5B.
Figure 5B:
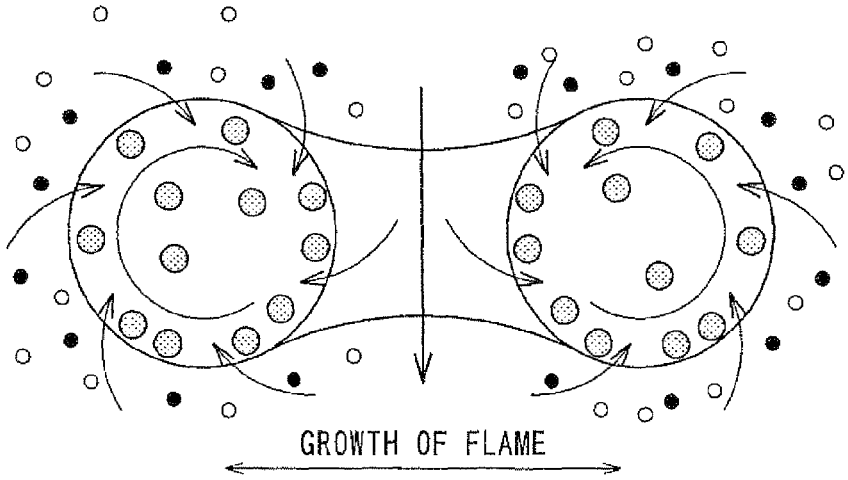

FIGS. 5A and 5B are schematic diagrams showing a flame kernel, ejected from the ignition device, which is growing from a state shown in FIG. 5A to a subsequent state shown in FIG. 5B.

Figure 6A:
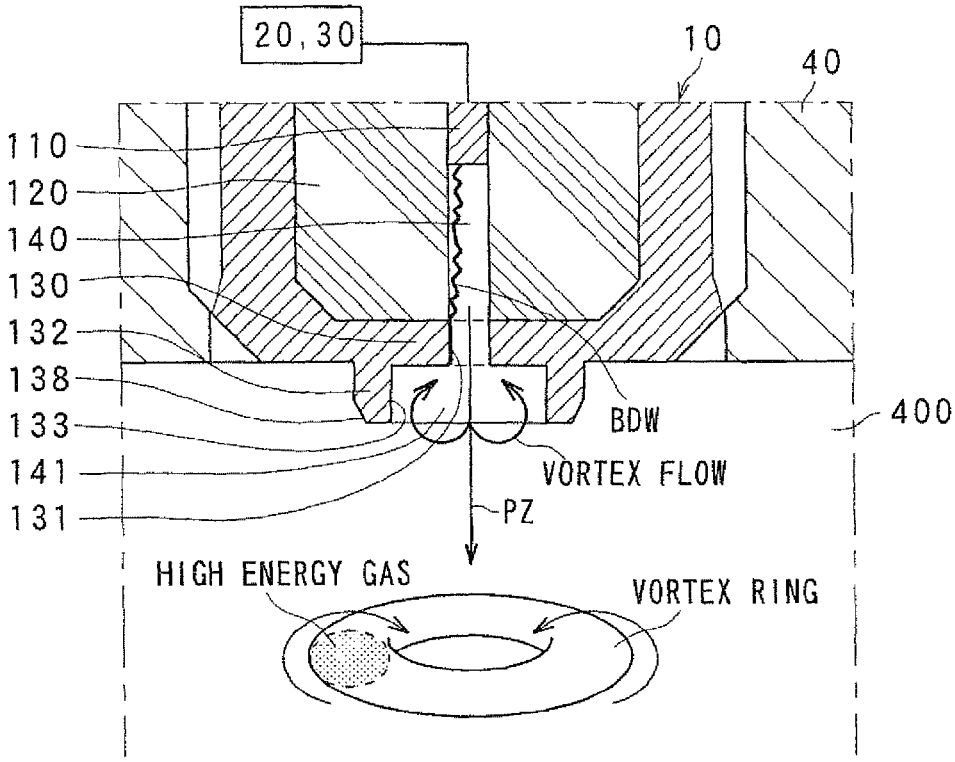
FIG. 6A is a partial sectional view showing plasma ejected from the ignition device of the first embodiment of the present invention.
Figure 6B:
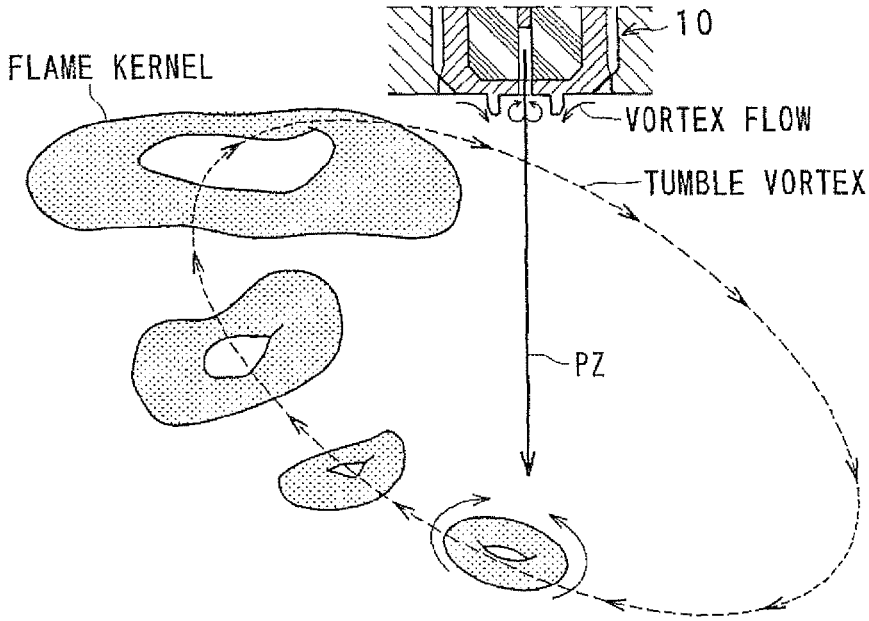
FIG. 6B is a schematic diagram showing the growing flame kernel in the first embodiment of the present invention.

FIG. 6A is a partial sectional view showing the ignition plug 10 at a time of discharge, and FIG. 6B is a schematic diagram showing a growth process of the flame kernel in the ignition device 1 of the present invention that is used in a combustion chamber of an internal combustion engine.

Figure 7A:
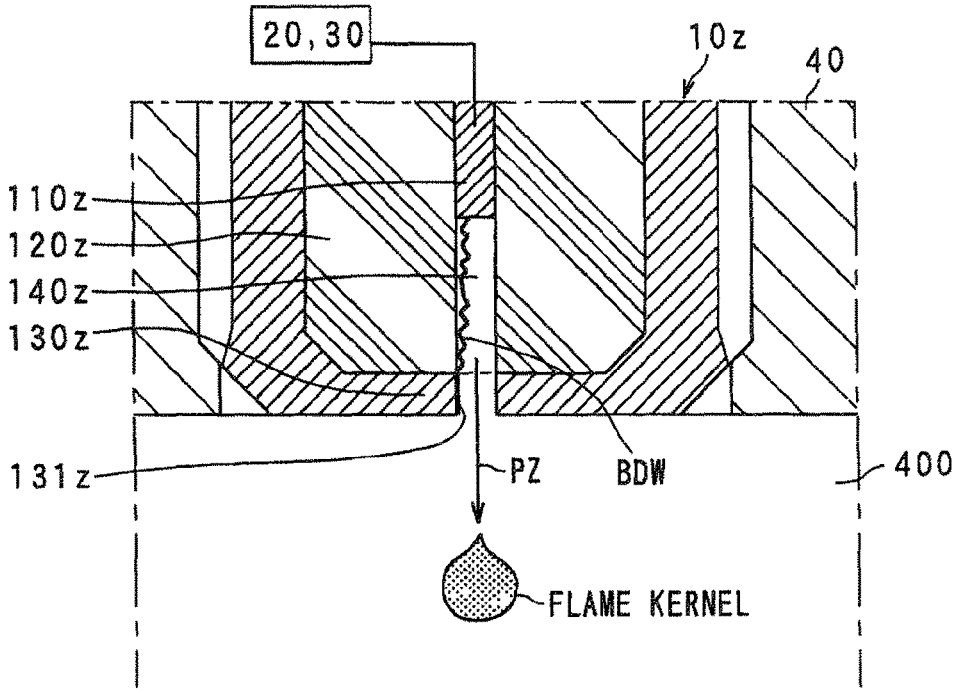
FIG. 7A (PRIOR ART)
FIG. 7A is a partial sectional view showing plasma at a time it is ejected from a comparative example of a conventional ignition device.
Figure 7B:
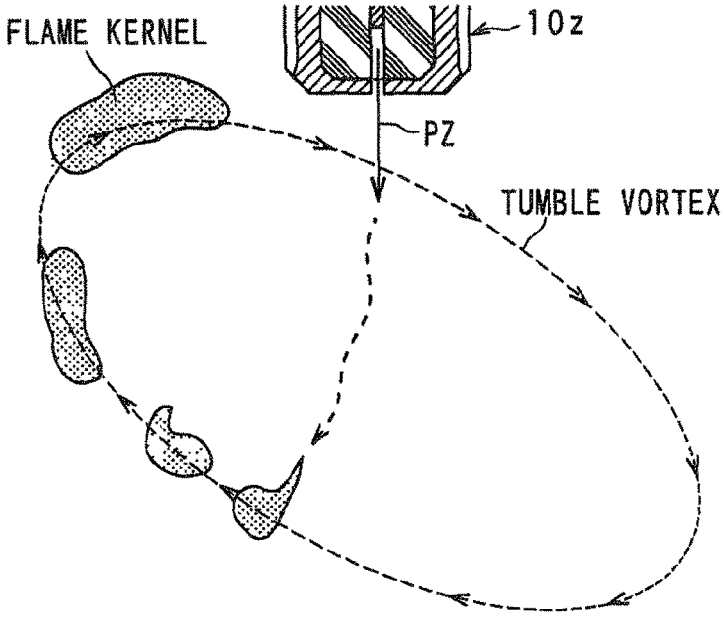
FIG. 7B (PRIOR ART)
FIG. 7B is a schematic diagram showing a flame kernel in a growing process in the conventional ignition device.

FIGS. 7A and 7B show a comparative conventional ignition plug 10*z*, wherein FIG. 7A is a schematic partial sectional view showing the ignition plug 10*z* at a time of discharging, FIG. 7B is a schematic diagram showing a growth process of the flame kernel in the conventional ignition device.

In this conventional ignition plug 10*z*, when high voltage is applied from the discharge power source 20, it breaks the insulation between the lower end surface of the center electrode 110 and the ground electrode open portion 131, generating breakdown discharge BDW that runs along the inner wall surface of the insulator 120.

At this time, high current flows from the plasma energy supply power source 30, which causes electrons having high energy to be discharged around a discharge route, and causes gas in the discharge space 140 to be ionized and to be ejected from the discharge space 140 in a plasma state having high temperature and high pressure.

In this stage, as shown in FIGS. 4A and 6A, plasma PZ ejected from the discharge space 140 expands in a radial direction in the rotation supply space 141 that is provided as the rotation supply mechanism, which enlarges the speed difference between the central portion of the plasma ejected from the discharge space 140 and the proximity of the inner peripheral wall face 133 of the second open portion 132. This causes the plasma to form a vortex flow moving from its inside to the outside.

The vortex flow provides the plasma PZ with rotational force, and as shown in FIG. 4B, the rotational force continues to act after ejected from the rotational force supply space 141, which causes the gas to form a vortex field and a vortex ring, as shown in FIG. 6B, which moves in the ejected direction while expanding in the radial direction and rotating.

The vortex ring moving rotationally in the combustion chamber 400 receives less air resistance, so that it can move for a long distance and that it allows the flame kernels to reach a desired position in the air-fuel mixture.

In addition, as shown in FIG. 5A, the vortex ring encloses the gas PZ having high energy and provides the enclosed high energy to the air-fuel mixture, while absorbing the surrounding air-fuel mixture by its rotational movement.

Further, the strong rotational force makes the vortex ring advance forward even in a cylinder (combustion chamber) in which the gas is flowing. Therefore, a non-matured flame kernel, which is not grown enough, just ejected form the ignition plug 10 can move to a desired position in the combustion chamber without being blown by the gas flow in the cylinder.

Further, as shown in FIGS. 5B and 6B, the flame kernel grows sufficiently by the ring's rotational force, absorbing the surrounding air-fuel mixture while maintaining its doughnut-like shape.

Therefore, the flame kernel grows steadily and improves the ignition performance even in the lean combustion engine, which provides an ignition device with high reliability in the ignition performance.

Further, the vortex ring has an advantage in capability of enclosing the gas, which allows the flame kernel to hold in its inside the energy for a long time, which is provided from the plasma energy supply power source 30. Therefore, the flame kernel efficiently utilizes the energy, thereby resulting in easy ignition with lower energy.

As shown in FIG. 6B, the flame kernel with a vortex ring shape ejected from the ignition plug 10 continues to grow and advance forward in the combustion chamber 400, in which the gas flow such as tumble vortex and swirl is generated, with its strong rotational force and advancement by enclosing the surrounding air-fuel mixture.

The grown flame kernel having a relatively large size, stable condition and slower movement further grows by moving in the combustion chamber 400 with the gas flow and by enclosing the air-fuel mixture. This mechanism allows the flame kernel to ignite in a combustion engine using fuel of relatively low flammability such as a lean combustion engine and a supercharged combustion engine.

On the other hand, as shown in FIG. 7A, the plasma PZ ejected from a discharge space 140*z* of the conventional ignition plug 10*z* forms a flame kernel having a relatively large bulk with an eye-drop shape.

And, as shown in FIG. 7B, the flame kernel ejected in a combustion chamber 400 from the conventional ignition plug 10*z* grows to a belt-like shape by moving with the gas flow in the cylinder and by reacting with the surrounding air-fuel mixture.

However, the flame kernel is blown by the gas flow before it grows to a state sufficient to ignite, because of an opening diameter of a ground electrode open portion 131*z* in the conventional ignition plug 10*z*, which is too small to provide sufficient size of vortex flow and advancement force to the flame kernel.

Therefore, the flame kernel does not have enough force to enclose high energy gas within the flame kernel, which can allow the energy gas inside the flame kernel to diffuse outside before the flame kernel grows sufficient enough to ignite in the combustion engine using fuel of relatively low flammability.

FIGS. 8 to 15 show test results conducted for the present invention in comparison with a conventional device. In the test results, the comparative example refers to the conventional ignition plug 10*z* that is shown in FIG. 7.

The practical example refers to the first embodiment of the ignition plug 10 according to the present invention. A test result conducted using the circuit shown in FIG. 2 is presented as the practical example 1, and a test result conducted with the circuit shown in FIG. 3 is presented as the practical example 2.

The tests were conducted using ignition plugs of the present invention and the conventional device each of which was mounted to an engine-imitated cylinder in which air-fuel mixture having a predetermined ratio is provided under the same condition.

The ignition performance was compared based on:

(1) combustion variation of indicated mean effective pressure (COV IMEP) calculated based on measurement of continuous 100-cycle combustion pressure wave patterns;

(2) stable combustion lean boundary air-fuel ratio provided based on the criterion in which COV IMEP is set 5%;

(3) initial combustion period and primary combustion period; and (4) energy decreasing effect at a predetermined air-fuel ratio.

Figure 8:
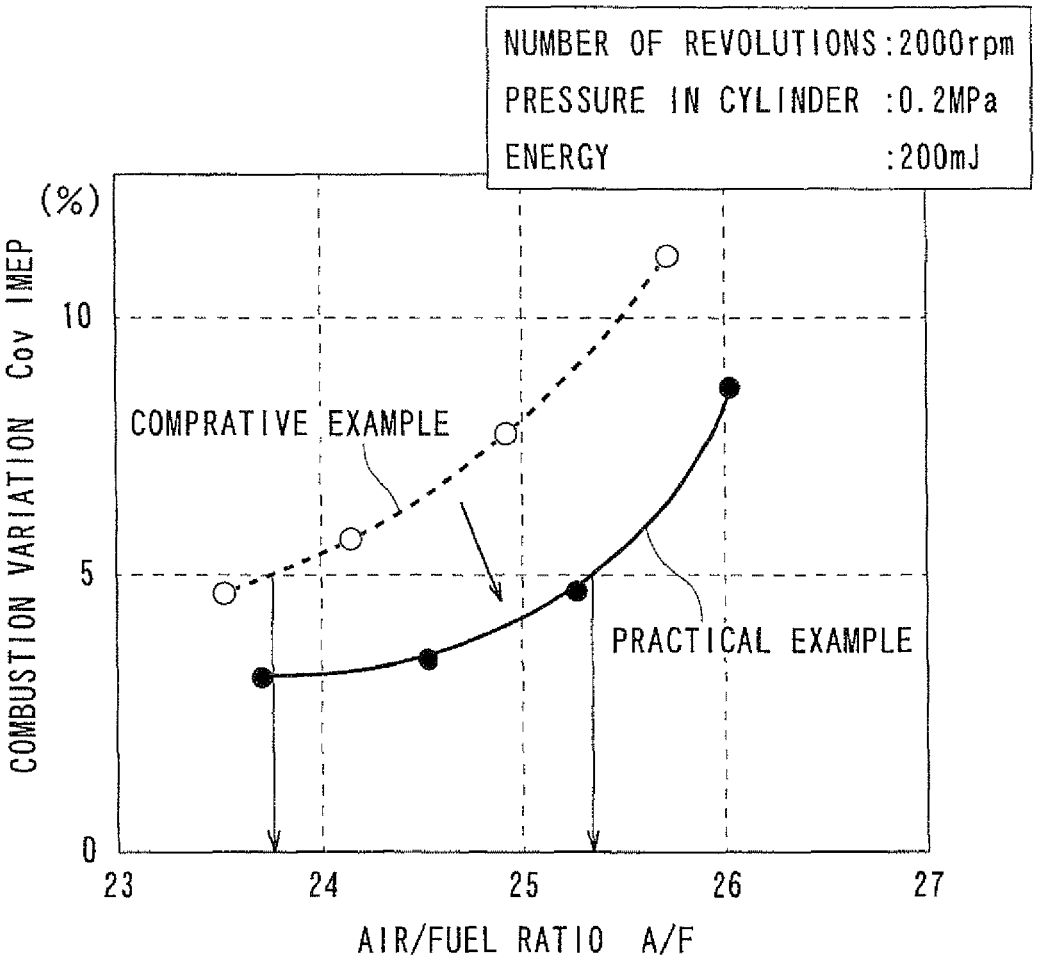
FIG. 8 is a characteristic diagram showing the effect of the present invention and the comparative example with respect to a combustion variation.

As shown in FIG. 8, the combustion variation (COV IMEP) of the practical example of the present invention resulted in lower than that of the comparative example. This indicates that the ignition device in the present invention provides stable ignition.

Figure 9:
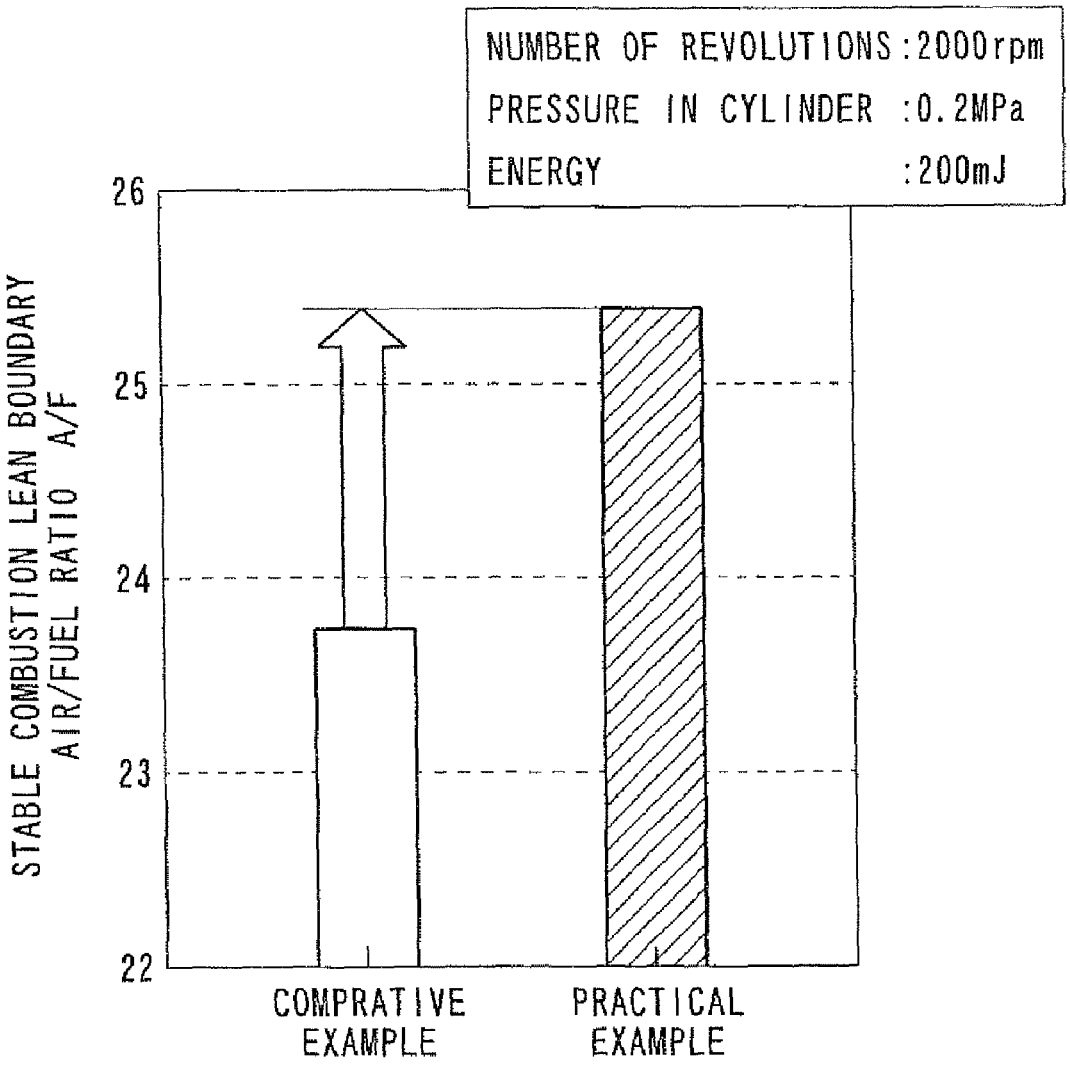
FIG. 9 is a characteristic diagram showing the effect of the present invention and the comparative example with respect to the lean boundary air fuel ratio.

Further, as shown in FIG. 9, the practical example of the present invention resulted in higher air-fuel ratio (25.3) than the comparative example (23.8) in the lean boundary air-fuel ratio defining stable combustion with respect to the same energy (200 mJ) supplied in respective cylinders having the same predetermined pressure (0.2 Mpa). This test demonstrates that the ignition device of the present invention is determined to be capable of combustion in the much leaner air-fuel ratio.

Figure 10:
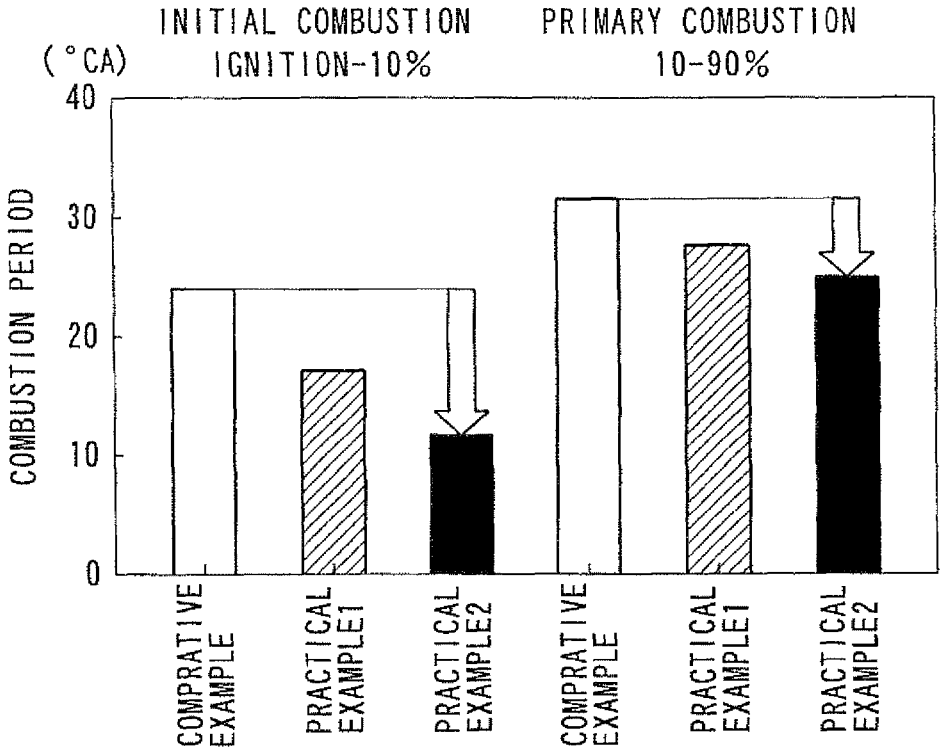
FIG. 10 is a characteristic diagram showing the effect of the present invention and the comparative example with respect to the combustion performance.

Further, as shown in FIG. 10, the present invention can significantly shorten the combustion period compared to the conventional device (comparative example) in both the initial combustion period and the primary combustion period.

The initial combustion period is defined by crank angle from the ignition time to the combustion ratio of 10%. The primary combustion period is defined by the crank angle from the combustion ratio of 10% to 90%. This test result shows that the ignition device in the present invention has excellent ignition performance.

Further, supplying energy to the ignition plug 10 in a sequence of pulses (example 1) for a single ignition was determined to provide more stable combustion than supplying energy to the ignition plug 10 at once (the practical example 2) for a single ignition.

Figure 11:
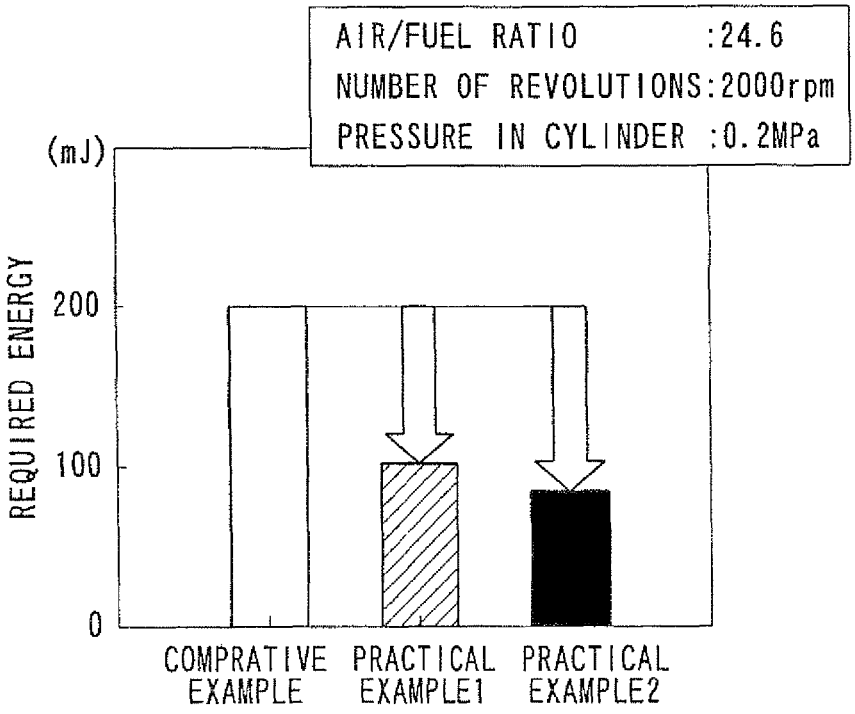
FIG. 11 is a characteristic diagram showing the effect of the present invention and the comparative example with respect to the required energy.

FIG. 11 shows the required energy decreasing effect of the present invention, which was conducted using the air-fuel ratio that was determined by the conventional ignition plug 10*z* (comparative example).

The air-fuel ratio was determined by finding stable ignition with energy of 200 mJ in the conventional plug 10*z*. The present invention using the ignition plug 10 in the first embodiment determined the required energy decreasing effect under the same air-fuel ratio.

As shown in FIG. 11, the present invention is determined to decrease approximately 10% the required energy used for stable ignition under the same air-fuel ratio as the comparative example (conventional ignition plug).

Figure 12:
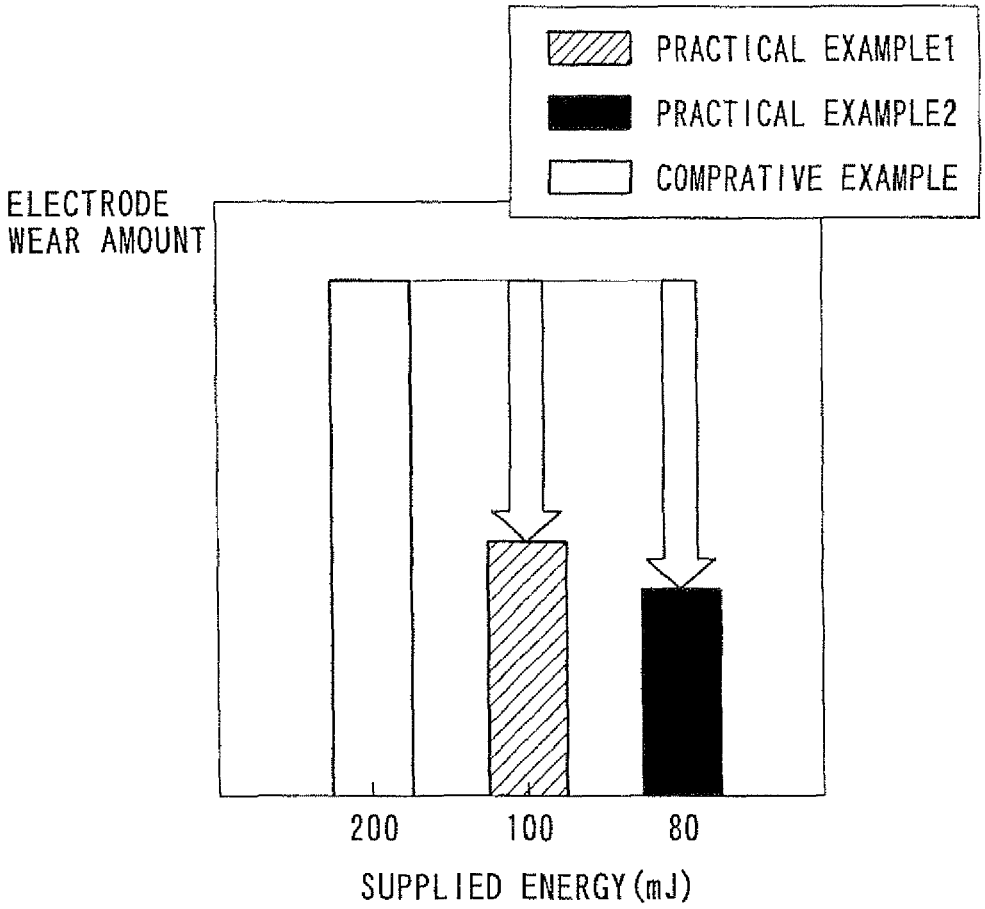
FIG. 12 is a characteristic diagram showing the effect of the present invention with respect to the improved durability, particularly the variation of the worn out amount of an electrode relative to supplied energy.

FIG. 12 is a characteristic view showing the durability effects of the present invention, in particular the variation of wearing amount in electrodes each of which provides respective energy.

As described hereinbefore, the present invention can decrease consumption of energy required in ignition, so that, as shown in FIG. 12, the ignition device in the present invention is provided with higher reliability by decreased energy supply to reduce wear on the electrode.

Figure 13:
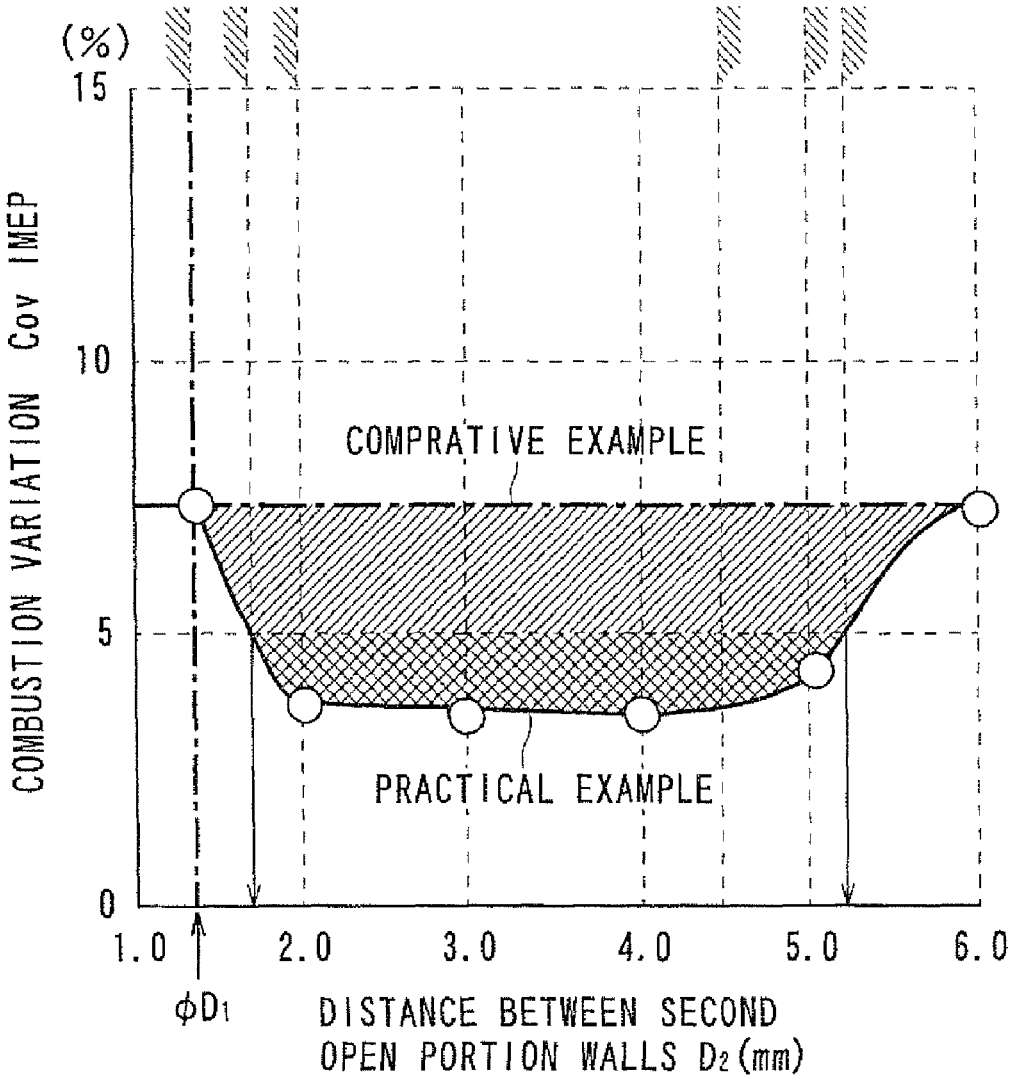
FIG. 13 is a characteristic diagram of the ignition device in the present invention and the comparative example with respect to the optimal condition of the distance between two wall faces.

With reference to FIG. 13, the effect of the distance D2 between the wall faces of the second open portion 132 will be described. FIG. 13 is a characteristic view showing the measurement result of the combustion variation of the ignition plug 10 of the first embodiment of the present invention in which the distance D2 is varied. The combustion variation of the conventional ignition plug 10*z* is also shown as the comparative example.

As shown in FIG. 13, the ignition plug 10 in the present invention resulted in the smaller combustion variation than the comparative example, wherein the distance D2 satisfies the following formula 1.

$$1.0 \times D1 < D2 < 4.5 \times D1 \quad \text{(formula 1)}$$

Further, the distance D2 was preferably determined by the following formula.

$$15 \times D1 \leqq D2 \leqq 4.25 \times D1$$

Setting the distance D2 following this formula can provide the further stable ignition performance with the combustion variation (COV IMEP) equal to or less than 50%.

Figure 14:
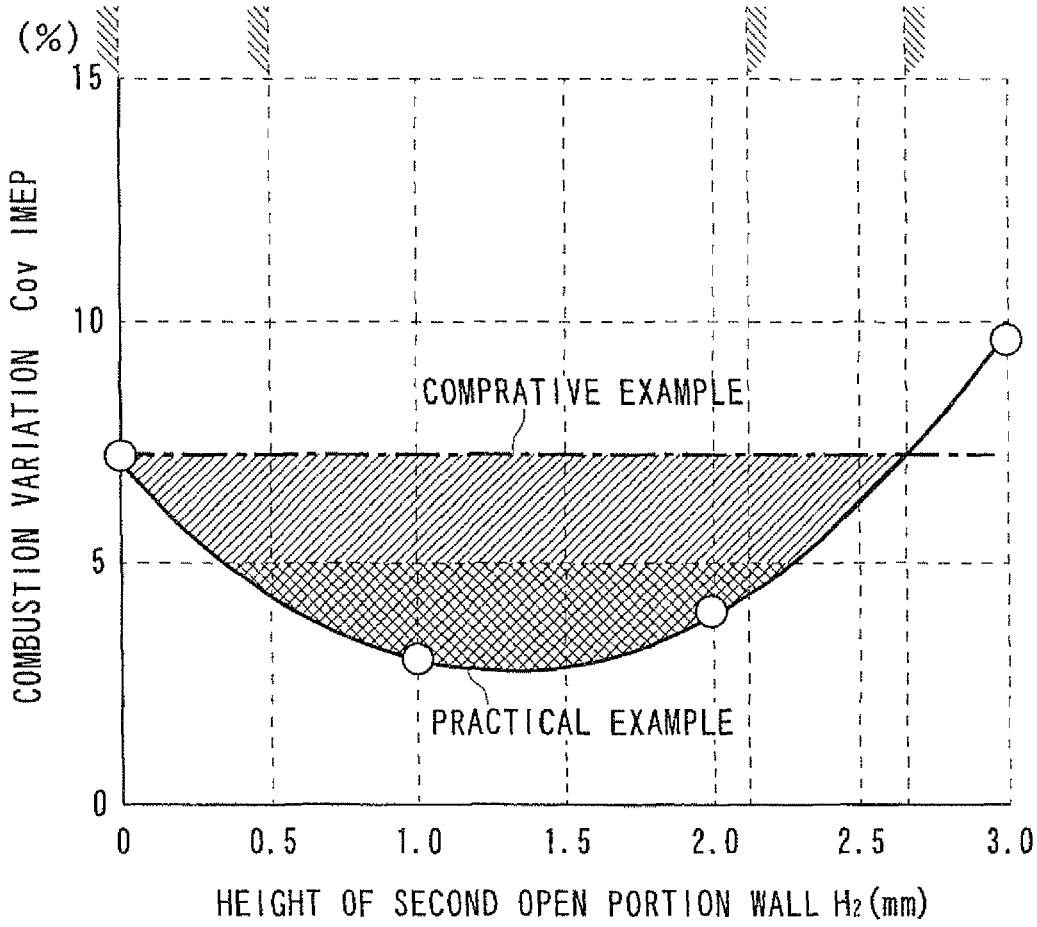
FIG. 14 is a characteristic diagram showing the effect of the ignition device according to the present invention and the comparative example with respect to the height of the wall face.

With reference to FIG. 14, the effect of the height H2 of the peripheral wall face 13 of the second open portion 132 will be described. FIG. 14 is a characteristic view showing a test result of the combustion variation conducted using the ignition plug 10 of the first embodiment of the present invention in which the height H2 was varied. FIG. 14 also shows the combustion variation of the conventional ignition plug 10*z* as the comparative example.

As shown in FIG. 14, the ignition plug 10 in the present invention resulted in the smaller combustion variation than the comparative example, wherein the height H2 satisfies the following formula 2.

$$0 < H2 \leqq 2.7 \quad \text{(formula 2)}$$

Further, the height H2 was preferably determined by the following formula.

$$0.5 \leqq H2 \leqq 2.3$$

Setting the height H2 following this formula can provide the further stable ignition performance with the combustion variation (COV IMEP) equal to or less than 50%.

The height H2 equal to or more than 2.0 mm produces the larger combustion variation than the conventional device. This phenomenon could be resulted from the heat dissipation of the peripheral wall face 133, rather than the generation effect of the vortex rings that can be generated by the rotational movement.

The decreasing effect of the aspect ratio H1/D1 between the inner diameter ϕD1 of the first open portion 131 and the length H1 of the discharge space 140 will be described.

Enlarging the aspect ratio H1/D1 (for example, H1/D1>2) as much as possible has been considered to be effective to lengthen the ejected distance of the plasma.

However, the enlarged aspect ratio H1/D1 requires higher voltage needed to break down the insulation of the discharge space 140, and can wear the electrodes in a shorter time.

The inventors examined the aspect ratio H1/D1 with which the stable combustion variation can be provided under the lean boundary A/F (25.3), which is similar to that of the conventional device, by varying the aspect ratio of the ignition plug 10 of the first embodiment in the present invention.

The aspect ratio H1/D1 of the conventional ignition plug 10*z* was set 2 (two) as the comparative example.

Figure 15:
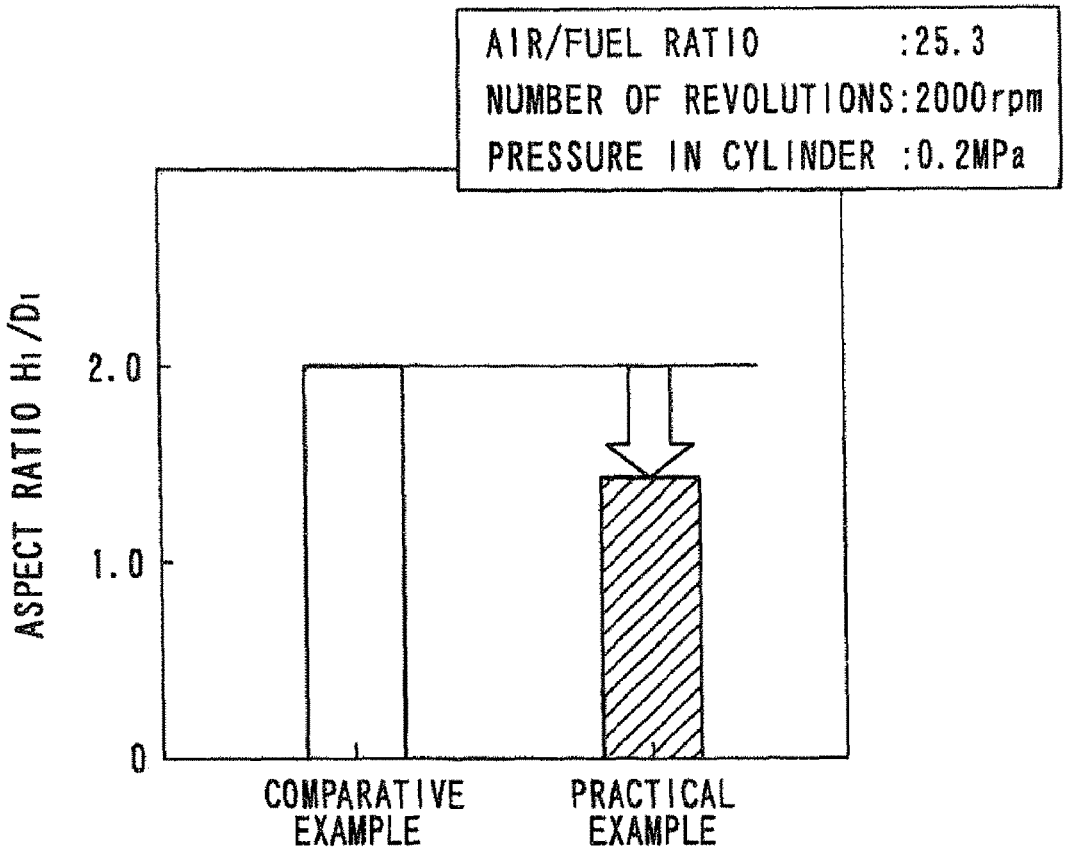
FIG. 15 is a characteristic diagram showing the effect of the present invention and the comparative example with respect to the aspect ratio.

As shown in FIG. 15, the present invention was found to generate combustion variation similar to that of the comparative example, with the aspect ratio H1/D1 of 1.5.

Accordingly, the present invention was found to provide the stable ignition performance with restrained electrode wear by setting the aspect ratio H1/D1 that satisfies the following formula 3.

The aspect ration H1/D1 is determined between the inner diameter ϕD1 of the first open portion 131 and the length H1 of the discharge space 140.

$$H1/D1 \geqq 1.5$$

Figure 16A:
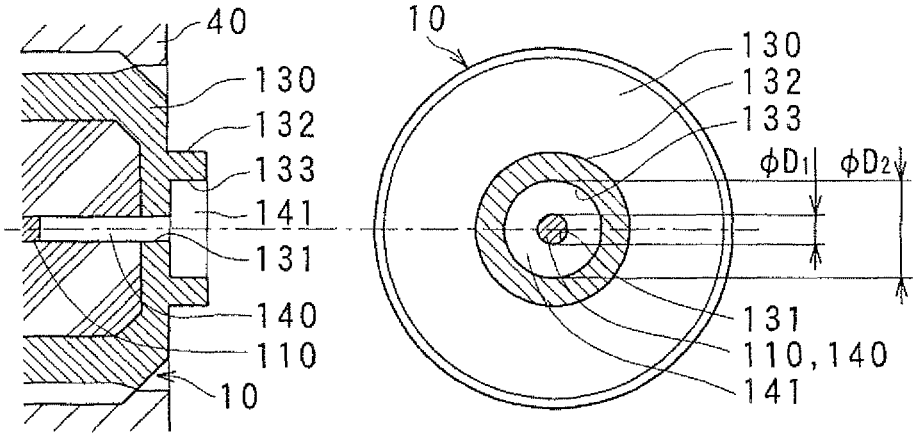
FIG. 16A is a partial sectional view and a bottom view showing the ignition device of the first embodiment of the present invention.
Figure 16B:
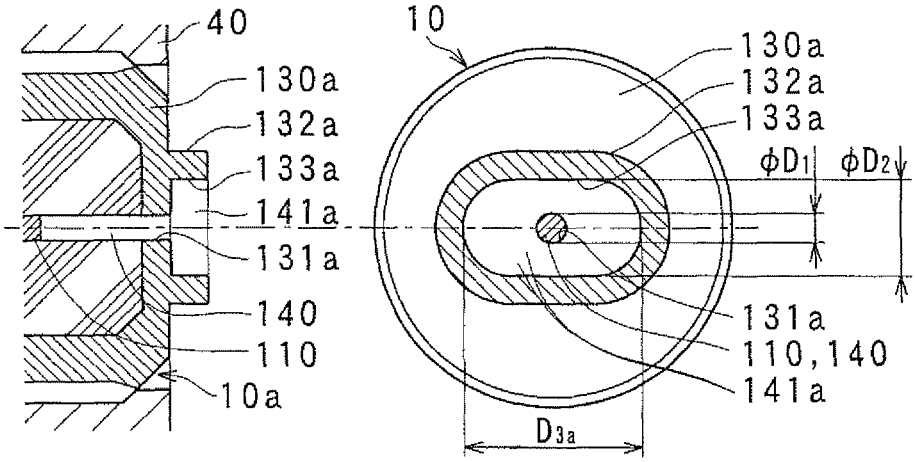
FIGS. 16B and 16C are partial sectional views and bottom views showing modified rotation supply mechanism of the first embodiment in the present invention.
Figure 16C:
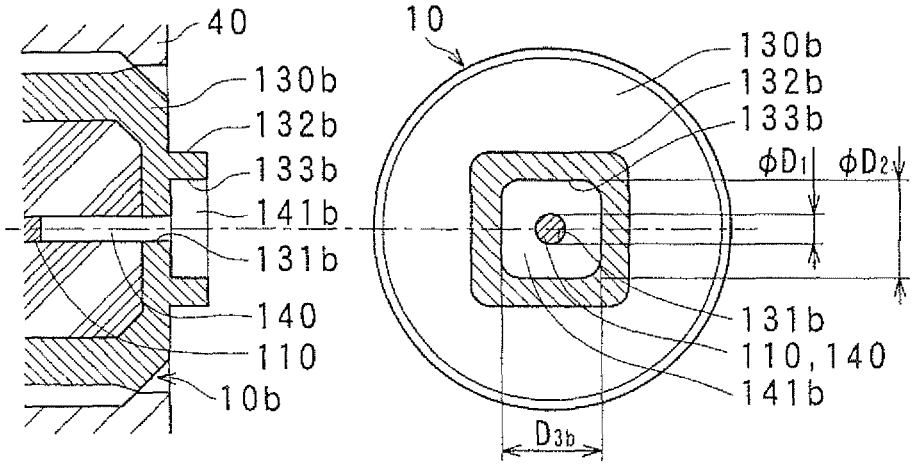

FIGS. 16A, 16B and 16C show respective ignition plugs 10, 10*a*, 10*b*, which are modified from the ignition plug of the first embodiment of the present invention. The drawings illustrated in the left side are partial sectional views, and those in the right side are their bottom views.

The peripheral wall face 133 of the second open portion 132 can be formed in a tubular shape having the inner diameter D2 (FIG. 16A). Or, the peripheral wall face 133*a* of the second open portion 132*a* can be formed in an ellipse tubular shape or an oval tubular shape having the distance D2 between the wall faces in the short axis direction and the distance D3*a* between the wall faces in the long axis direction (FIG. 16B).

Further, the peripheral wall face 133*b* of the second open portion 132*b* can be formed in a rectangle tubular shape having the distance D2 between the wall faces in the short axis direction and the distance D3*b* between the wall faces in the long axis direction (FIG. 16C).

The advantages of the present invention can be provided by at least setting the distance D2 between the wall faces to satisfy the formula 1. The distances D3*a* and D3*b* between the walls faces in the long axis direction can be modified with respect to the combustion characteristic of the inner combustion engine to be used.

With reference to FIGS. 17 and 18, the rotational power supply mechanism, which is a primary portion of the present exemplary embodiment, provided with preferable configurations will be described in detail.

Figure 17A:
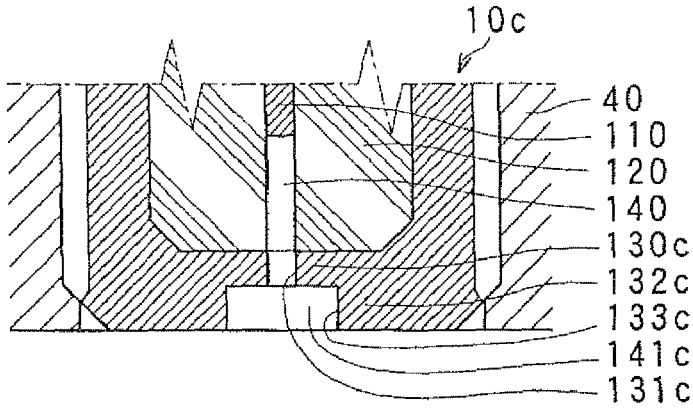
FIG. 17A is a partial sectional view showing the ignition plug 10*c* of a second embodiment of the present invention.

FIG. 17A is a partial sectional view showing a second embodiment of the ignition plug 10*c* in the present invention. This ignition plug 10*c* is comprised of a rotational force supply space 141*c* that is defined by a second open portion 132*c* prepared by a peripheral wall face 133*c*.

Figure 17B:
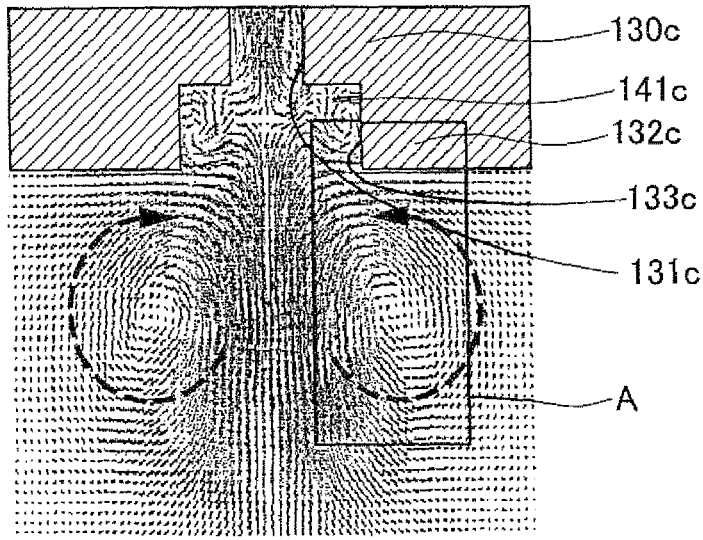
FIG. 17B is a flow analysis view at a state 0.35 ms after the gas is ejected.
Figure 17C:
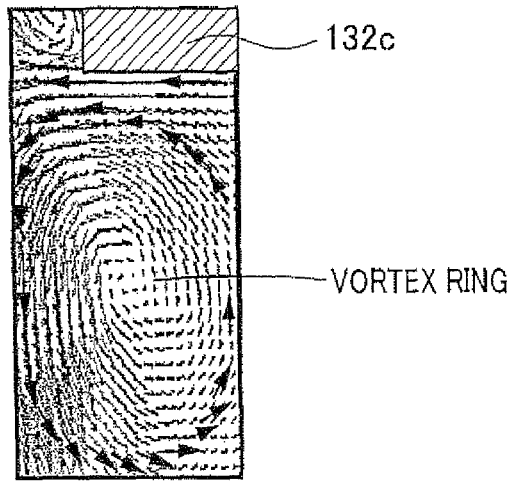
FIG. 17C is an enlarged view of the part "A" indicated in FIG. 17B.

The peripheral wall face 133*c* is formed in the apical end side portion of the first open portion 131*c* formed in the thickly formed ground electrode 130*c*. FIG. 17B is a flow analysis view showing a simulation result of the ejected plasma flow 0.35 ms after the plasma ignition plug 10*c* is provided with high energy. FIG. 17*c* is an enlarged view of the portion "A" in FIG. 17B.

Figure 18A:
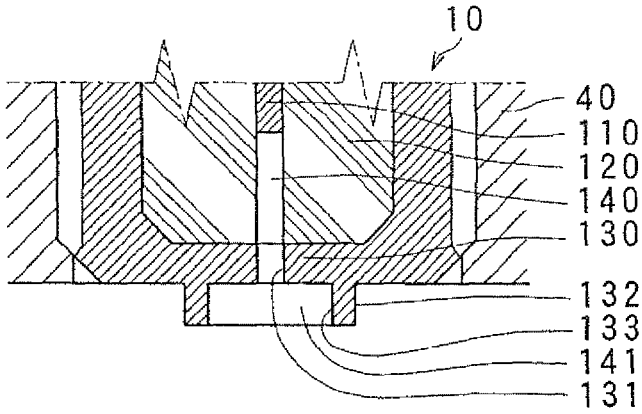
FIG. 18A is a partial sectional view of the ignition plug 10 of the first embodiment in the present invention.

FIG. 18A is a partial sectional view showing the ignition plug 10 of the aforementioned first embodiment of the present invention, which has a rotation supply space 141 defined by the tubular peripheral wall face 133 that projects toward the apical end side of the first open portion 131 to surround the first open portion 131.

Figure 18B:
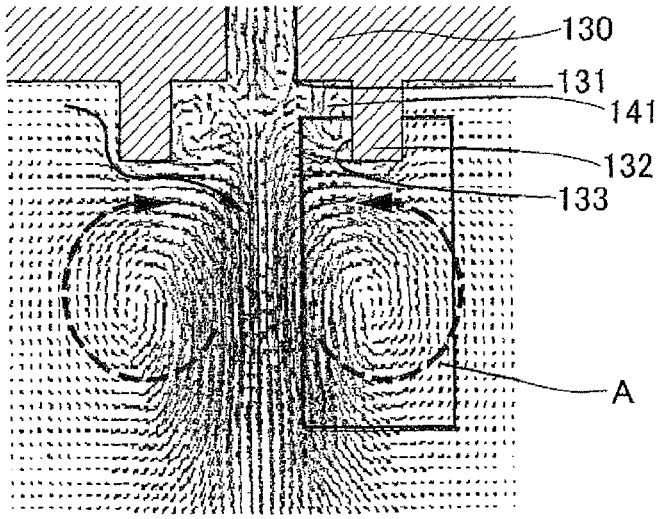
FIG. 18B is a flow analysis view at a state 0.35 ms after the gas is ejected.
Figure 18C:
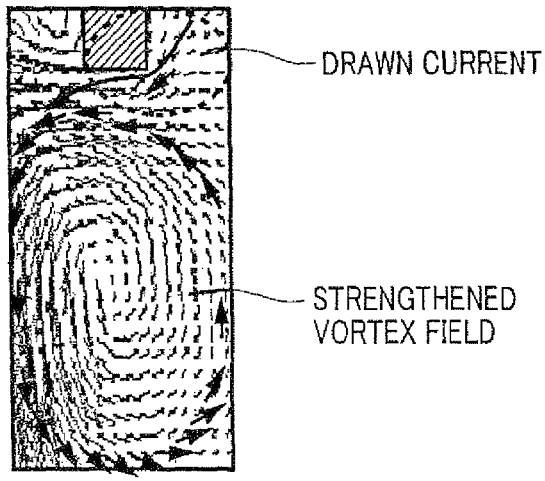
FIG. 18C is an enlarged view of the part "A" indicated in FIG. 18B.

FIG. 18B is a flow analysis view showing a simulation result of the ejected plasma flow 0.35 ms after the plasma ignition plug 10*c* is provided with high energy. FIG. 18*c* is an enlarged view of the portion "A" in FIG. 18B.

As shown in FIG. 17B, the vortex flow is generated in the rotational force supply space 141*c* in this second embodiment, as well. And, as shown in FIG. 17*c*, the vortex flow ejected from the rotation force supply space 141*c* forms the vortex field.

The ignition plug 10*c* in the second embodiment was also found to have the improved ignition performance by the generated vortex ring, compared to the conventional plasma ignition device.

However, this ignition plug 10*c* was found to have the inferior ignition performance compared to the first embodiment, which comprises the tubular second open portions 132, 132*a*, 132*b* projecting to the combustion chamber, because of the vortex ring having weaker rotational force.

This is assumedly caused by the restrained ejected speed of the gas flow, as shown in FIG. 17*c*, which receives the strong flow from the vertical direction on the surface of the second open portion 132*c*.

The first embodiment of the present invention, on the other hand, has much improved ignition performance. This is presumably caused by the second open portion 132 projecting into the combustion chamber, to which the gas flowing in the vertical direction with respect to the ejected gas flow hits and changes its direction to the crosswise direction relative to the ejected gas flow (forming the "drawn current").

Then the gas flow toward the ejected gas flow generates the vortex flow around the second open portion 132, which enhances the rotation of the vortex ring. This action makes the vortex ring advance forward further, and allows the flame kernel to steadily grow, thereby resulting in the improved ignition performance.

Other embodiments of the present invention will be described referring to FIGS. 19 to 21.

Figure 19A:
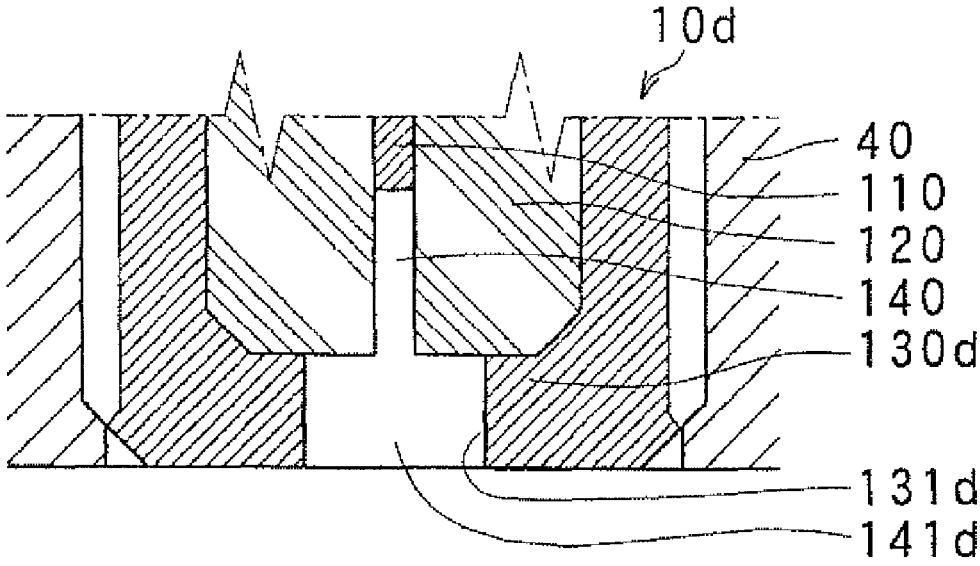
FIG. 19A is a partial sectional view of the ignition plug 10*d* of a third embodiment of the present invention.

A third embodiment of the present invention shown in FIG. 19A comprises a rotation supply space 141*d* in which the opening diameter of a ground electrode open portion 131*d* is made larger than the opening diameter of the insulator 120 that forms the discharge space 140.

This embodiment was found to have the improved ignition performance compared to the conventional plasma ignition device because of the generated vortex rings, like the aforementioned embodiments.

However, this embodiment was recognized to have the inferior ignition performance compared to the first embodiment, which comprises the tubular second open portions 132, 132*a*, 132*b* projecting to the combustion chamber, because of the vortex ring having weaker rotational force.

This is supposedly caused by unstable growth of the flame kernels. High current applied between the center electrode 110 and the ground electrode 130 generates a creeping discharge that runs on the surface of the insulator 120 inside the discharge space 140.

Figure 19B:
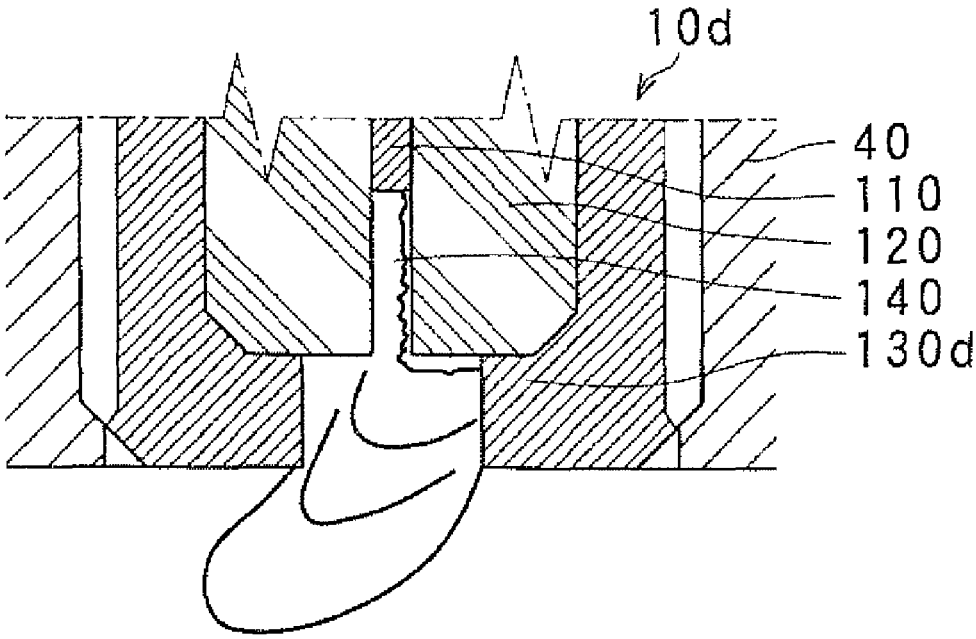
FIG. 19B is a partial sectional view showing a problem of the third embodiment.

As shown in FIG. 19B, this creeping discharge having strong anisotropy then sharply turns and runs on the surface perpendicular to the surface of the insulator 120 and causes the plasma to be ejected.

It is because the lower end face of the insulator 120 is partially exposed and a first open portion 131*d* of the ground electrode 30*d* is made widely open. This causes the vortex ring to have anisotropy and to be deformed, thereby deteriorating the advancement force and enclosing effect of the vortex rings, resulting in the unstable growth of the flame kernels.

However, making the opening diameter of the first open portion 131*d* larger than the opening diameter of the insulator 120 like in this embodiment is expected to be effective in restraining the electrode wear.

This is because the discharge route is pulled toward the first open portion 131*d* (the outer periphery direction of the insulator 120) having the larger diameter than the inner periphery face of the insulator 120, which leads to the generation of the creeping discharge in the discharge space 140 without inducing the aerial discharge, thereby decreasing required voltage needed to break down the insulation properties in the discharge space 140.

Figure 20A:
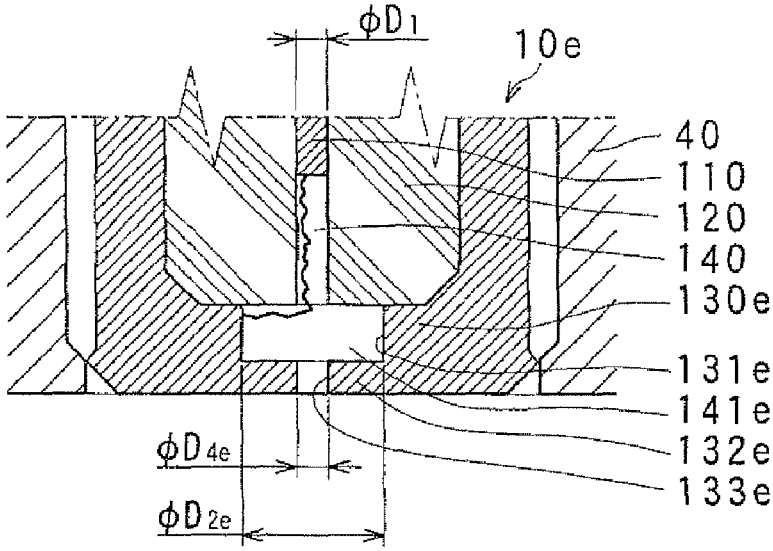
FIG. 20A is a partial sectional view of the ignition plug 10*e* of a fourth embodiment of the present invention.

Therefore, a fourth embodiment of the ignition plug 10*e* in the present invention, which is shown in FIG. 20A, provides a second open portion 132*e* that is formed by narrowing the inner diameter of the apical end side of a rotation force supply space 131*c*, continuous with a first open portion 131*e*.

With this construction, the plasma ejected from the discharge space 140, no matter which direction it is ejected, stays in a rotation force supply space 141*e* for a longer time and is then ejected from a second open portion 132*e* in the vortex ring form. Accordingly, the ignition plug 10*e* provides stable ignition performance.

Figure 20B:
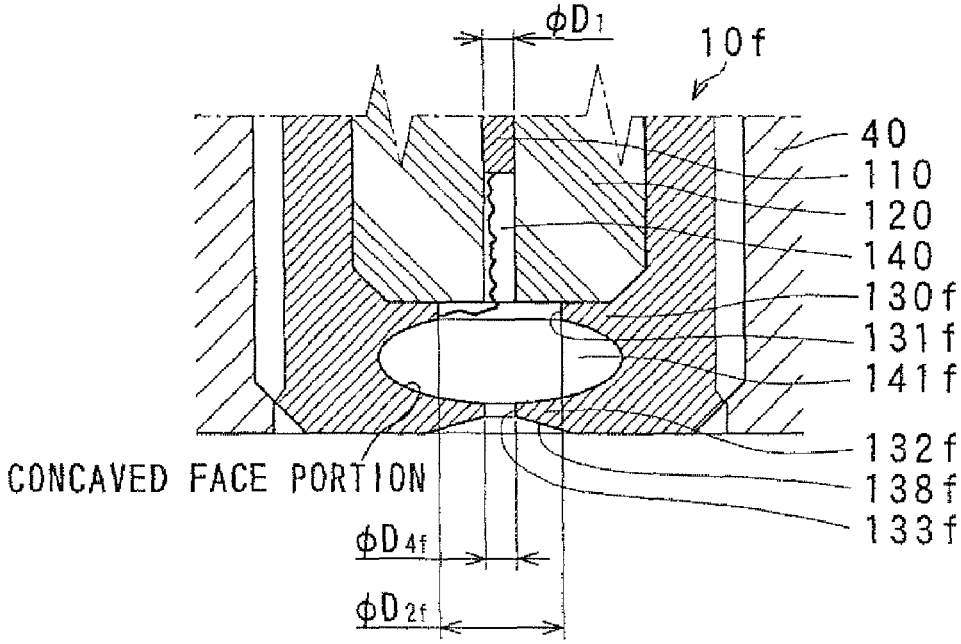
FIG. 20B is a partial sectional view of the ignition plug 10*f* of a fifth embodiment of the present invention.

As shown in FIG. 20B, a fifth embodiment of the ignition plug 10*f* in the present invention has a first open portion 131*f* and a second open portion 132 between which is concaved in the outer periphery direction, forming a concaved face portion. Such a construction allows the ground electrode 130*f* to form substantially a thin circular shape, which can concentrate the electric field at the first open portion 131*f*, resulting in generation of the creeping discharge by lower voltage.

Further, the concaved peripheral wall of the rotation force supply space 141*f* causes the vortex flow to rotate smoothly and permits the vortex ring to be ejected quickly from the rotation force supply space 141*f*. Therefore, energy applied by the ignition plug 10*f* can be sufficiently enclosed in the vortex ring, which can accelerate the stable growth of the flame kernel.

Moreover, this embodiment provides a taper portion 138*f* formed by a tapered bottom face side of the second open portion 132*f*. This taper portion 135*f* can enhance the rotational force of the vortex ring ejected from the second open portion 132*f*.

Figure 21A:
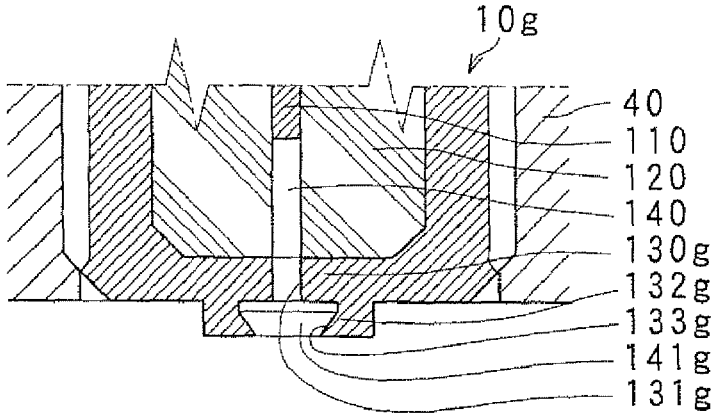
FIG. 21A is a partial sectional view showing the ignition plug 10*g* of a sixth embodiment of the present invention.

A sixth embodiment of the ignition plug 10*g* in the present invention, which is shown in FIG. 21A, comprises a rotation supply space 141*g* having substantially a reversed-circular conical surface. This circular conical surface is formed by an inner peripheral wall face 133*g* of a second open portion 132*g*, which is partially narrowed in the direction toward its apical end.

In this construction, the plasma ejected from the first open portion 131*g* forms the vortex ring while expanding in the outer diameter direction, and then its periphery velocity is accelerated by the succeeding plasma ejected from the discharge space 140*g*, and it is ejected in the combustion chamber through the apical end of the second open portion 132*g*.

When the plasma is ejected in the combustion chamber, the flame kernel is provided with the powerful rotational force and grows, keeping its vortex ring form. Such a phenomenon can provide the ignition device with the good ignition performance.

The rotation supply space 141*g* can be formed to have a circular conical surface by partially narrowing the inner peripheral wall face 133*g* of the second open portion 132*g* in the apical end direction.

Such an embodiment can also improve the ignition performance in comparison with the conventional plasma ignition device like the abovementioned embodiment, but it was found to be inferior compared to the abovementioned embodiment because of weaker rotational force of the vortex ring.

Figure 21B:
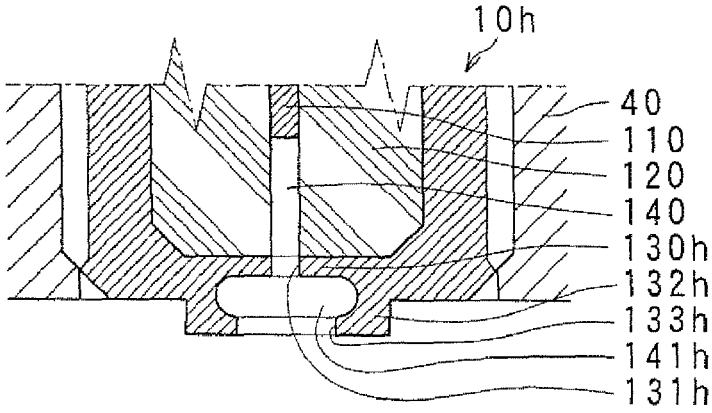
FIG. 21B is a partial sectional view showing the ignition plug 10*h* of a seventh embodiment of the present invention.

As shown in FIG. 21B, a seventh embodiment of the ignition plug 10*h* in the present invention comprises the rotation supply space 141*h* having a concaved peripheral wall formed at the inner peripheral wall face of a second open portion 132*h*, which is partially concaved in substantially a circular shape toward the outside.

Such a configuration can provide the same advantage as the aforementioned embodiment. Further, such a configuration allows the vortex ring, which rotates and expands in the outer diameter direction, to be formed in the rotation supply space 141*h* that is defined by the peripheral wall having the concave face.

The vortex ring while staying in the rotation supply space 141*h* accelerates its periphery velocity caused by the succeeding plasma ejected from the discharge space 140. And, when the periphery velocity of the vortex ring is sufficiently high, the vortex ring is partially ejected from the rotation supply space 141*h*. This partial vortex ring with its pull action causes the larger size of vortex ring to be ejected in the combustion chamber through the apical end of the second open portion 132*h*.

This ejection of the vortex ring generates powerful rotational force, which makes the flame kernel grow while allowing it to keep its vortex ring form. This rotation supply space 141*h* provides the gas flow with speedy rotation, and provides the ignition device with the ignition performance further stable.

The opening diameter of the second open portion 132*h* can be made larger than the opening diameter of the first open portion 131*h*, which can form a larger vortex ring without obstructing the vortex flow.

This embodiment was found to provide less satisfying ignition performance with high energy supplied in a single pulse for a single ignition, as shown in FIG. 2B, though this could provide vortex ring with higher moving speed.

On the other hand, it was found to provide highly stable ignition performance with high energy supplied in as a sequence of pulses for a single ignition, as shown in FIG. 3B.

The is presumably caused by the enhanced heat dissipation effect in the heat energy that is transmitted to the cylinder head 40 through the ground electrode 130, resulting from the extended staying time in the rotation force supply space 141*h*. That is, when the high energy is applied at once, the energy in the discharge space 140 is not utilized for plasma conversion and is dissipated because of the saturated plasma in the vicinity of the discharge route.

On the other hand, when the high energy is supplied as a sequence of pulses, the gas in the discharge space 140 is constantly energized and is continuously ejected in the form of high temperature/high pressure plasma, fully utilizing the supplied energy in the discharge space 140 to be used for plasma conversion of the new gas.

Figure 21C:
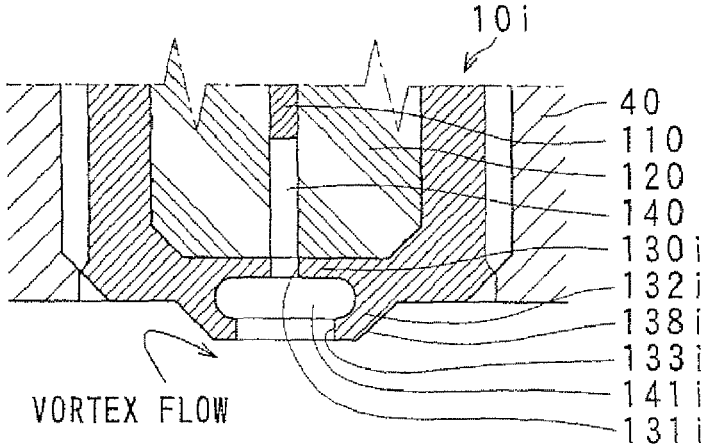
FIG. 21C is a partial sectional view showing the ignition plug 10*i* of an eighth embodiment of the present invention.

As shown in FIG. 21C, an eighth embodiment of the ignition plug 10*i* in the present invention comprises a taper face 138*i* formed by a declined outer periphery of a second open portion 132*i*, in addition to the construction similar to the abovementioned ignition plug 10*h*.

This construction allows the ignition device to form stable flame kernels and to have the better ignition performance because of the vortex flow that provides the rotational force to the vortex ring ejected from the ignition plug 10*i*. The vortex flow is generated when the gas in the cylinder hits the outer periphery face of the second open portion 132*i*.

Within the scope of the present invention, the rotation supply mechanism in the invention can be modified depending on the type of combustion engine to be used, the type of fuel to be supplied, and the driving condition of the combustion engine. For example, the aforementioned embodiments exemplified the plasma ignition device having a single ignition plug, but the present invention can also be applied to the device having a plurality of ignition plugs.

Further, the aforementioned embodiments exemplified the construction having two power sources that include the discharge power source 20 and the plasma energy supply power source 30 as high voltage sources, but the present invention can be comprised of a single power source from which the discharge power source 20 and the plasma energy supply power source 30 are provided in the dissimilar voltage controlled by a device such as a Dc-Dc converter.

Moreover, although the aforementioned embodiments exemplified the regular ignition coil as a pressure rising circuit of the discharge power source, the present invention can use an apparatus such as a condenser discharge-type ignition coil (C.D.I) or a piezoelectric transformer.

What is claimed is:

1. An ignition device, comprising:

a center electrode having an elongated shaft shape;

an insulator having a tubular shape, the insulator extending around and below the center electrode; and a ground electrode extending around and below the insulator and having a first open portion of diameter D1 communicating with a bottom end open portion of the insulator at an apical end of said ignition device;

the center electrode, the insulators and the ground electrode defining a discharge space of the ignition device;

the discharge space, in operation, being provided with high voltage from a discharge power source and high current from a plasma energy supply power source to form plasma having high temperature and high pressure in the discharge space, the plasma being ejected into a combustion chamber to ignite a combustible therewithin;

wherein a rotation supply mechanism having a second open portion is provided at said apical end below said first open portion to provide a rotation supply space defined by an inner tubular peripheral oval face which, in operation, supplies rotational force to the plasma ejected from the discharge space in a direction from the periphery towards a center of the plasma; and $1.0 \times D1 < D2 < 4.5 \times D1$ where D1 is an opening diameter of the first open portion, and D2 is a distance between two opposing wall faces of the second open portion.

2. The ignition device in claim 1, which satisfies the following formula 2:

$$0 < H2 \leqq 2.7 \quad \text{(formula 2)},$$

wherein

H2 (mm) is a height of the peripheral wall face of the second open portion.

3. The ignition device in claim 1, wherein an inner face of the peripheral wall of the second open portion is partially circularly concaved toward an external side.

4. The ignition device in claim 1, wherein the inner face of the peripheral wall of the second open portion is partially narrowed toward its apical end to form the rotation supply space having substantially a circular conical shape.

5. The ignition device in claim 1, which satisfies the following formula 3:

$$H1/D1 \geqq 1.5 \quad \text{(formula 3)},$$

wherein

H1 is a length of an inner peripheral wall of the insulator between the lower end face of the center electrode and the upper end of an inner peripheral wall of the opening portion of the ground electrode, both together forming the discharge space, and D1 is an inner diameter of an inner peripheral wall of the insulator.

6. The ignition device in claim 1, wherein the high current from the plasma energy supply power source is dividedly supplied by pulse current with respect to a single provision of the high voltage from the discharge power source.

* * * * *